US012773588B2

(12) United States Patent
Roff et al.

(10) Patent No.: US 12,773,588 B2
(45) Date of Patent: Oct. 27, 2026

(54) GEOMETRIC PLAY STRUCTURE

(71) Applicant: Landscape Structures Inc., Delano, MN (US)

(72) Inventors: Tory Roff, Grand Rapids, MI (US); Mark Kangas, Delano, MN (US); Felipe Pena, Southlake, TX (US)

(73) Assignee: Landscape Structures, Inc., Delano, MN (US)

( * ) Notice: Subject to any disclaimer, the term of this patent is extended or adjusted under 35 U.S.C. 154(b) by 0 days.

(21) Appl. No.: 16/900,304

(22) Filed: Jun. 12, 2020

(65) Prior Publication Data

US 2020/0391067 A1 Dec. 17, 2020

Related U.S. Application Data

(60) Provisional application No. 62/861,114, filed on Jun. 13, 2019.

(51) Int. Cl.
*A63B 9/00* (2006.01)
*A63G 21/00* (2006.01)

(52) U.S. Cl.
CPC ..... *A63B 9/00* (2013.01); *A63B 2009/006* (2013.01); *A63G 21/00* (2013.01)

(58) Field of Classification Search
CPC ..... A63B 2009/006; A63B 71/023; A63B 9/00–2009/08; A63B 17/00; A63G 21/00; A63G 31/00
See application file for complete search history.

(56) References Cited

U.S. PATENT DOCUMENTS 3,666,266 A * 5/1972 Noguchi ..... A63B 9/00 482/35
3,949,985 A * 4/1976 Stampfli ..... A63B 9/00 482/35
4,097,043 A * 6/1978 Rudy ..... A63B 9/00 403/172
4,129,975 A * 12/1978 Gabriel ..... A63H 33/101 D8/382
4,603,583 A 8/1986 Heumuller
4,603,853 A * 8/1986 Satterthwaite ..... A63B 9/00 D25/4
5,496,232 A * 3/1996 Morris ..... A63B 9/00 482/148
5,505,035 A * 4/1996 Lalvani ..... E04B 1/19 52/648.1

(Continued)

FOREIGN PATENT DOCUMENTS

DE 102019116001 * 6/2019 ..... A63B 9/00
DE 102019116001 A1 12/2020

(Continued)

OTHER PUBLICATIONS

KR10-1059397 translation (derived from Espacenet) (Year: 2011).*

(Continued)

*Primary Examiner* — Megan Anderson
*Assistant Examiner* — Catrina A Letterman
(74) *Attorney, Agent, or Firm* — Jonas R. Mellang; Kelly, Holt & Christenson, P.L.L.C.

(57) ABSTRACT

A playground structure that includes a plurality of panels coupled to a frame so as to form at least the majority of (Continued)

regular polygon surfaces included in a uniform polyhedral shape.

15 Claims, 33 Drawing Sheets

(56) References Cited

U.S. PATENT DOCUMENTS

| | | | | |
|---|---|---|---|---|
| 10,576,388 | B2 * | 3/2020 | Briggs | A63B 9/00 |
| 2009/0176622 | A1 * | 7/2009 | Pizmony | F16B 7/0453 482/35 |
| 2018/0133606 | A1 | 5/2018 | Briggs et al. | |
| 2020/0384303 | A1 * | 12/2020 | Jones | A63G 31/00 |

FOREIGN PATENT DOCUMENTS

| | | | | |
|---|---|---|---|---|
| DE | 102019116001 | B4 | 12/2020 | |
| KR | 10-1059397 | * | 2/2011 | A63B 17/04 |
| KR | 101059397 | B1 | 8/2011 | |
| KR | 101162570 | B1 | 7/2012 | |
| KR | 10-1622886 | * | 5/2016 | A63G 21/00 |
| KR | 101622886 | B1 | 5/2016 | |
| KR | 101883287 | B1 | 7/2018 | |

OTHER PUBLICATIONS

KR10-1622886 translation (derived from Espacenet) (Year: 2016).*
Translation of DE102019116001 from Espacenet (Year: 2019).*
PCT/US2020/037501 International Search Report and Written Opinion dated Sep. 25, 2020, 9 pages.
Playworld.com/PlayCubes, accessed Apr. 29, 2019, 3 pages.
CA Patent Application No. 3141269, Office Action dated Feb. 8, 2023, 8 pages.
First Office Action for Singapore Patent Application No. 11202112874Q, Dated Mar. 12, 2024, 7 pages.
Office Action for Canadian Patent Application No. 3141269, Dated Mar. 6, 2024, 8 pages.
First Examination Report for Australian patent application No. 2020290961, Dated Mar. 24, 2025, 3 pages.
Office Action for Mexican Patent Application No. MX/a/2021/015146, Dated Mar. 18, 2025, 8 pages.
Singaporean Application No. 11202112874Q—Invitation to respond to Written Opinion, dated Jan. 17, 2025, 6 pages.
Office Action for Canadian Patent Application No. 3141269, Dated Apr. 14, 2025, 6 pages.
Office Action for Mexican Patent Application No. MX/a/2021/015146, dated Oct. 27, 2025, 20 Pages including Machine English Translation.

* cited by examiner

500

600

2700

GEOMETRIC PLAY STRUCTURE

CROSS-REFERENCE TO RELATED APPLICATION

The present application is based on and claims the benefit of U.S. provisional patent application Ser. No. 62/861,114, filed Jun. 13, 2019, the content of which is hereby incorporated by reference in its entirety.

BACKGROUND

Though some existing playground play systems are more creative than others, many companies in the industry continue to produce products that are ultimately "post and deck" type structures. Post and deck type structures are on the one hand interesting because they tend to promote "continuous play" to some extent, for example, where an individual can move from one play element to the next, possibly without ever touching the ground. However, while post and deck type systems may be modular enough to support flexible configuration to some extent, their "square" nature limits just how creative one can be when it comes to making design choices. It may come as no surprise that such limitations cause many current play systems to be perceived as being somewhat boring, aesthetically uninteresting or otherwise unappealing.

SUMMARY

A playground structure that includes a plurality of panels coupled to a frame so as to form at least the majority of regular polygon surfaces included in a uniform polyhedral shape.

DETAILED DESCRIPTION OF ILLUSTRATIVE EMBODIMENTS

Figure 1:
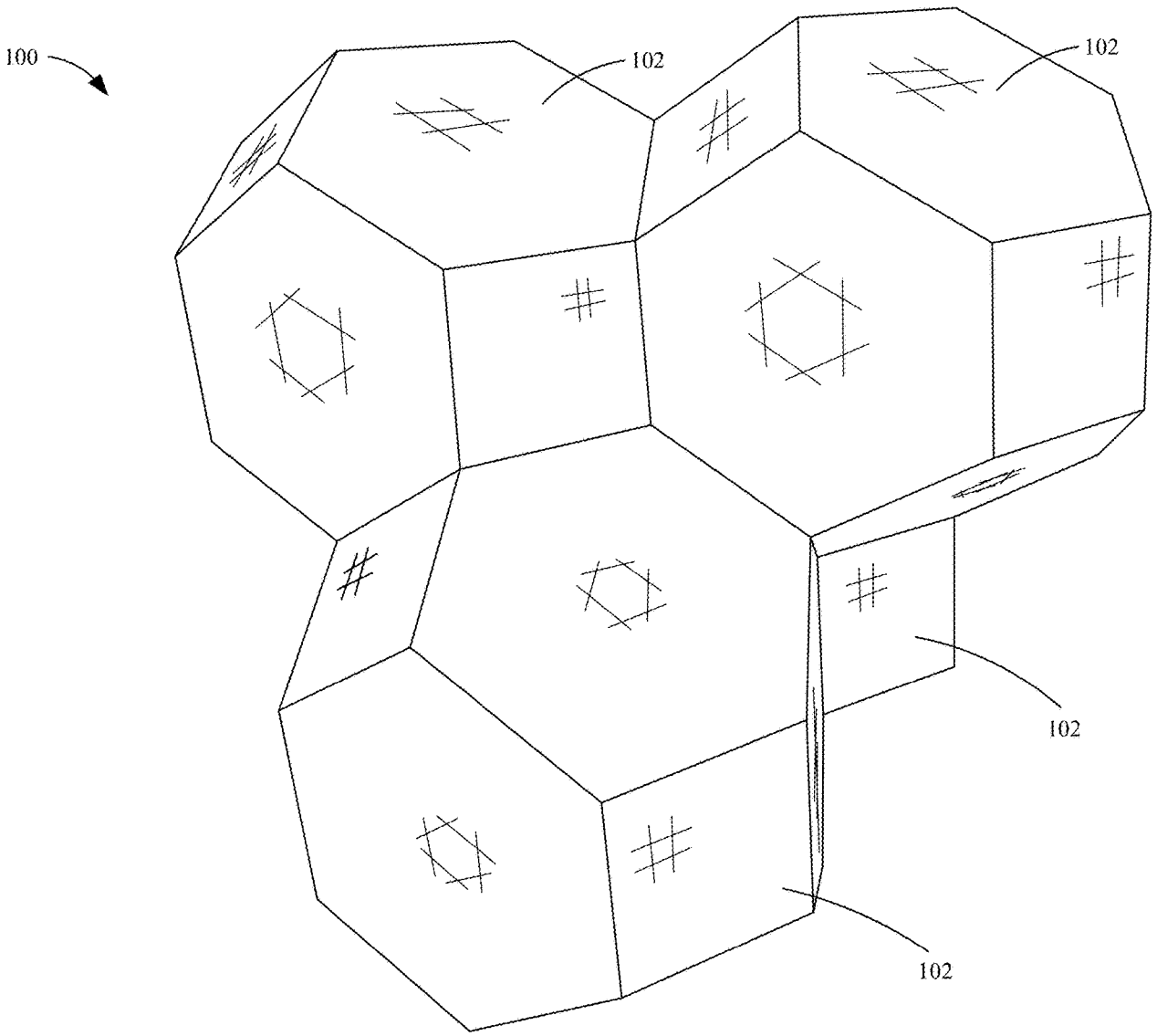
FIG. 1 is a simplified view showing an example play system.

FIG. 1 is a simplified view showing at least a portion of an example play system 100. Play system 100 includes a plurality of connected complex shapes 102. In one embodiment, each shape 102 is a generally a polyhedron and, in a more specific embodiment, each shape 102 is specifically a truncated octahedron. In this case, each shape 102 includes fourteen faces (eight hexagonal and six square), thirty-six edges, and twenty-four vertices. One or more of shapes 102 could just as easily be a shape other than a truncated octahedron. For example, one or more of the shapes 102 could be a square, a rectangle, a different Archimedean polyhedron, a different simple or complex polyhedron or any other shape. For example, FIG. 39 shows another geometric shape that can be used in place of a truncated octahedron. In one embodiment, but not by strict limitation, each shape is of a size and nature that a person can climb into or onto the shape while actively enjoying the associated play environment.

Figure 2:
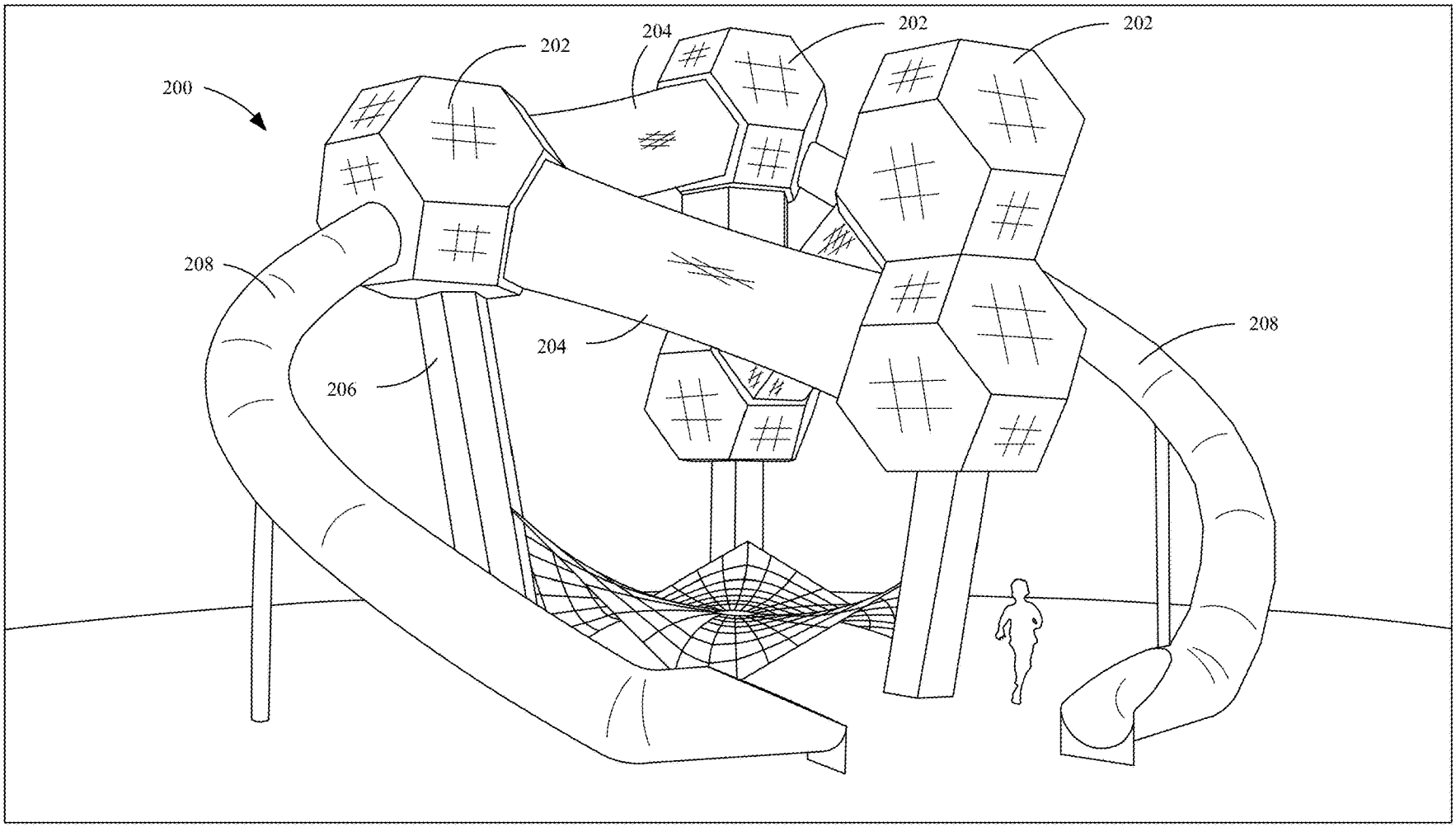
FIG. 2 is a perspective view showing an example play system.

FIG. 2 is a perspective view showing an example play system 200. Play system 200 includes a plurality of complex shapes 202 that are integrated with other types of play components. The shapes 202 are truncated octahedrons but, again, other three dimensional shapes could be substituted. Some of the other components in the broader play environment include tunnels 204, support 206, and slides 208. In other examples, truncated octahedron 202 can be coupled to additional or different components. FIG. 2 demonstrates that the components 202 are, in one embodiment, of a size and nature that enable a person to climb through them and even transition through them to other components in the play environment. And the Figure also shows that the shapes can be suspended above the ground illustratively supported by supports. In another embodiment, the shapes can be suspended in the air instead of supported from the ground. These and other approaches to supporting the shapes in the air are contemplated and should be considered within the scope of the present description.

Figure 3:
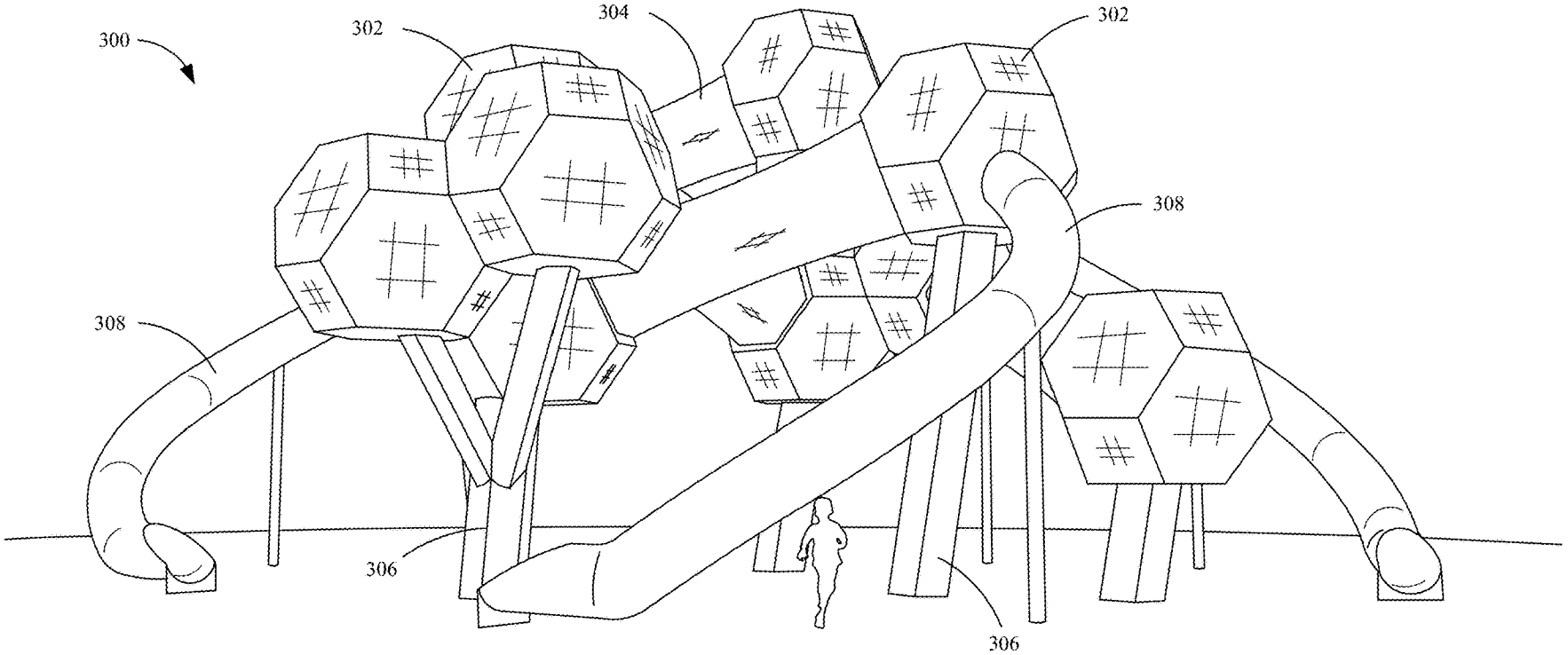
FIG. 3 is a perspective view showing an example play system.

FIG. 3 is a perspective view showing an example play system 300. Play system 300 includes a plurality of shapes 302 that are coupled to various components. For example, truncated octahedron 302 are coupled to bridges 304, supports 306, and slides 308. In other examples, truncated octahedron 302 are coupled to other or different play components. The purpose of FIG. 3 is simply to demonstrate the broad flexibility provided by shapes in terms of their ability to be integrated into a play environment in many different creative ways. The shapes 302 are again shown to be truncated octahedron's but alternatively be different shapes. Also, though it is shown so in FIG. 3, not all shapes need necessarily be the same.

Figure 4:
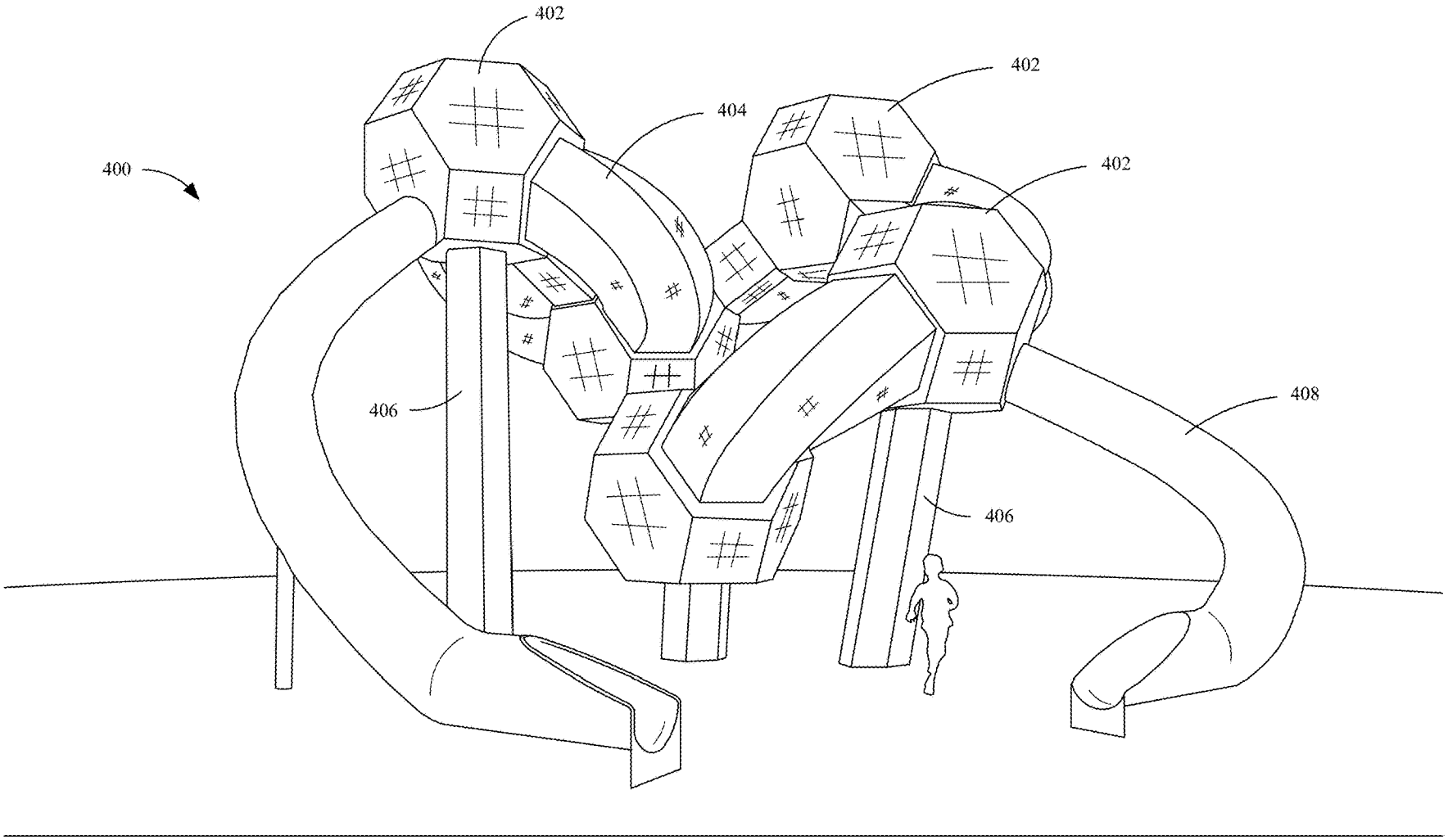
FIG. 4 is a perspective view showing an example play system.

FIG. 4 is a perspective view showing an example play system 400. Play system 400 includes shapes 402 that are coupled to various components. Again, the shapes are shown as truncated octahedrons only for illustrative purposes. Some example components in this configuration include tunnels 404, supports 406 and slides 408. In other examples, shapes 402 can be coupled to different play items or even more directly to one another, as was shown in FIG. 1. Further, shapes 402 can be coupled to directly or indirectly to other polyhedron shapes.

Figure 5:
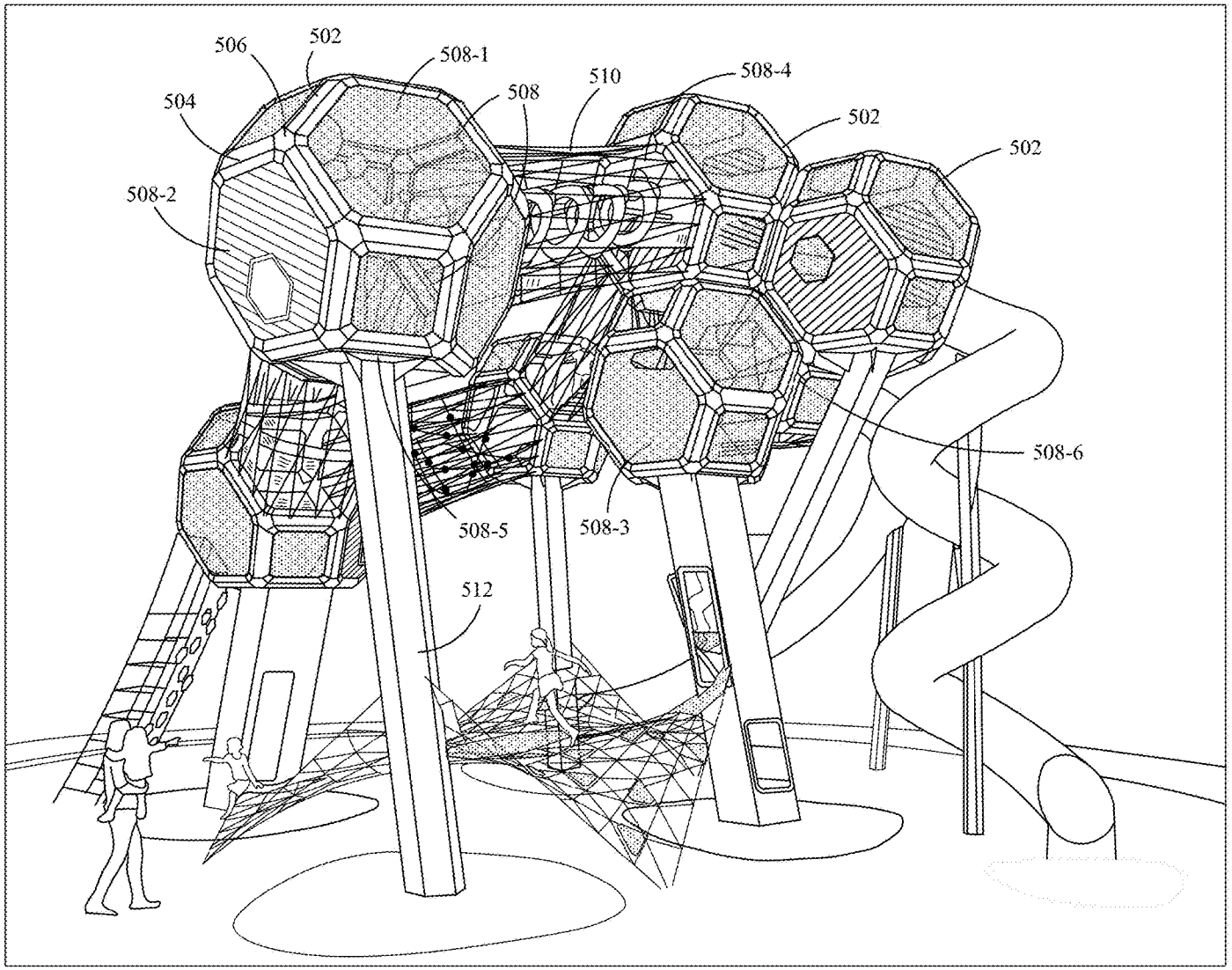
FIG. 5 is a perspective view showing an example play system.

FIG. 5 is a perspective view showing an example play system 500. Play system 500 includes shapes 502, which are again truncated octahedrons for example only. In this Figure, shapes 502 have been shown in more detail to include a plurality of edge pieces 504, joint pieces 506 and panels 508. Edge pieces 504 are configured to be coupled to other edge pieces 504 either directly (not shown) or by way of corresponding joint pieces 506.

Panels 508 are illustratively coupled to edge pieces 506 and/or joint pieces 506 so as to be framed in, at least to some degree. There is a wide variety of different panels 508 that can be incorporated into a shape. Some specific examples are shown in FIG. 5, but not by limitation. Panel 508-1 is a semi-transparent panel. Panel 508-2 includes slats and a hexagonal opening or window. Panel 508-3 is an opaque panel. Panel 508-4 includes an opening that provides access to a bridge 510. Panel 508-5 includes a support mechanism that couples to a support 512. Panel 508-6 panels are obscured from view in the Figure but illustratively include connecting mechanisms that support connection of one shape 502 to another shape 502. The panels shown are only examples intended to demonstrate the extremely flexible nature of the design. The options for panel 508 designs are truly limitless.

Figure 6:
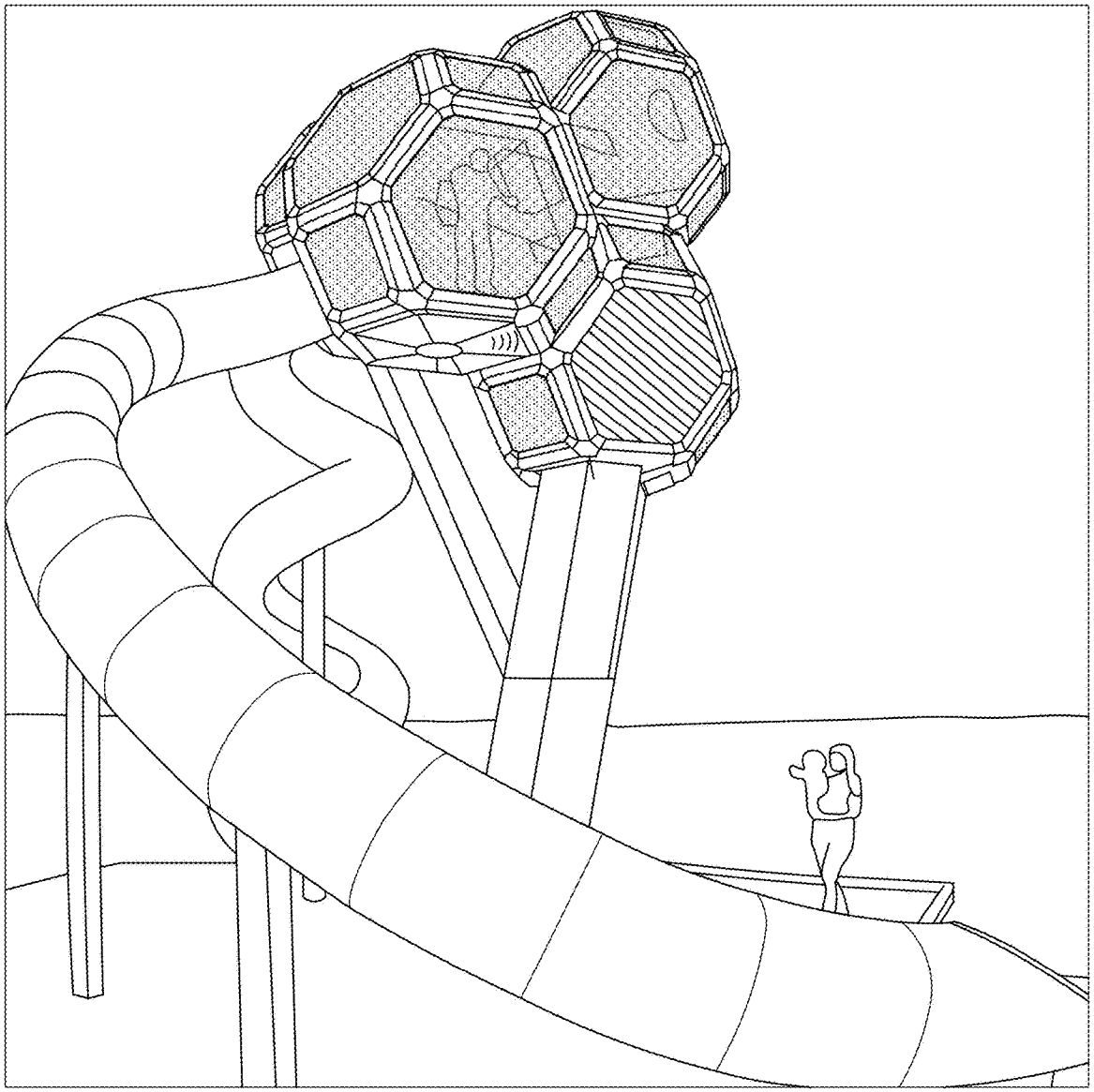
FIG. 6 is a perspective view of an example play system.

FIG. 6 is a perspective view of an example play system 600. The purpose of this Figure is to demonstrate how shapes are designed so as to be directly integrated to one another. In this case, the edge pieces and joint pieces are configured to support the direct integration. In one embodiment, specialized edge pieces or joint pieces are utilized in places where integration is desired, the specialized pieces the same or different than edge pieces and joint pieces located elsewhere in the design. In one embodiment, the direct integration design is such that one or more edge or joint pieces is left out in order to accommodate the integration. This can be true when integrating shapes directly to one another or when integrating with another play element. As is shown in FIG. 6, when shapes are directly integrated to one another, panels with an opening can be included at the point of integration to enable passage from one shape to another.

Figure 7:
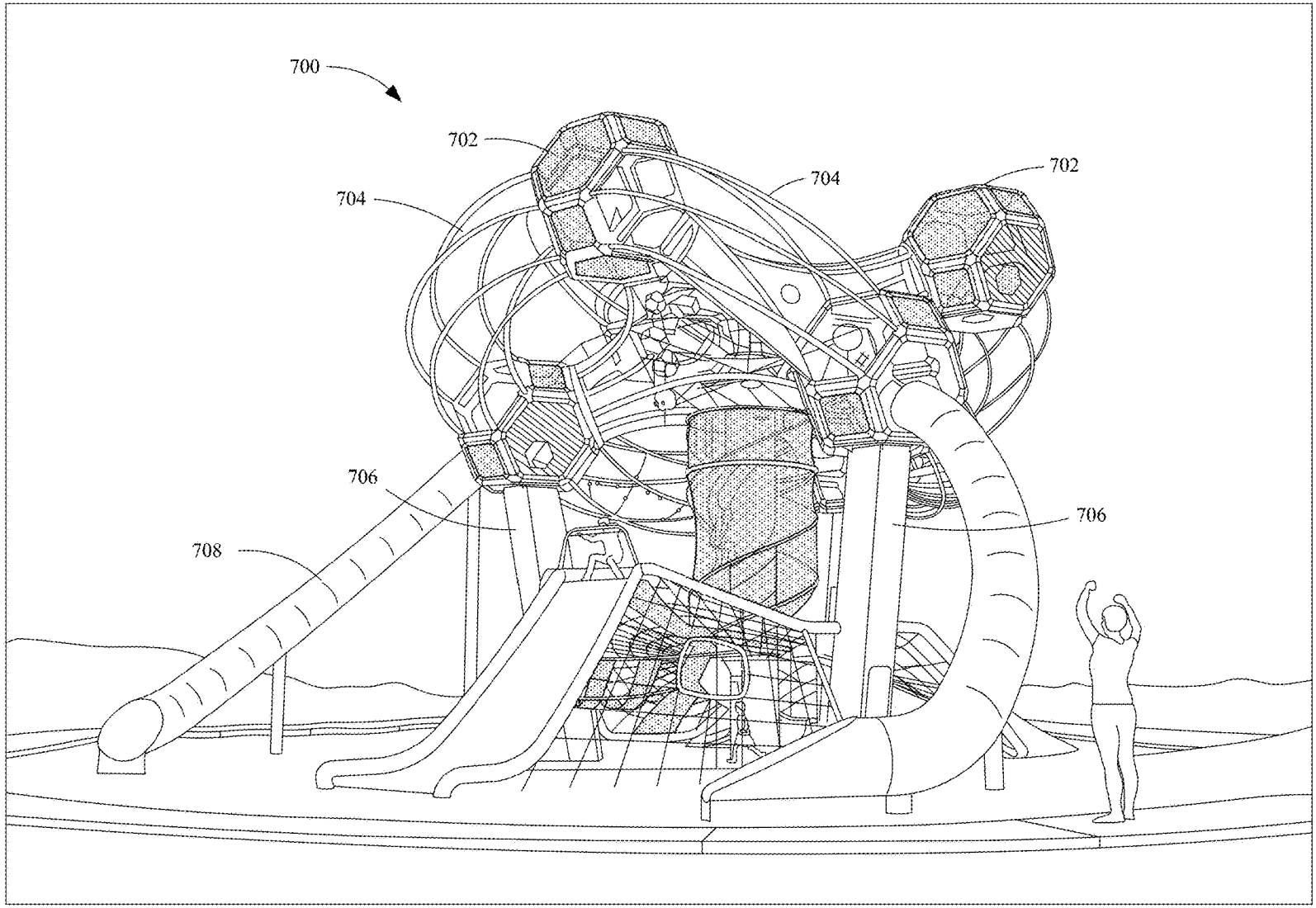
FIG. 7 is a perspective view showing an example play system.

FIG. 7 is a perspective view showing an example play system 700. Play system 700 includes a plurality of shapes 702, tunnels 704, supports 706 and slides 708. Play system 700 can include other or different items. The purpose of this Figure is simply to again demonstrate the creative flexibility of the shapes, again shown as truncated octahedrons. In this case, tunnels 704 enable climbing from one shape 702 to another. The supporting elements that form tunnels 704 are shown connecting to shapes 702 proximate to joint pieces. In one embodiment, a specialized joint or edge piece is configured to support this connection. In another embodiment, the system is configured to support the connection without any difference between joint or edge pieces at the connection point or elsewhere.

Figure 8:
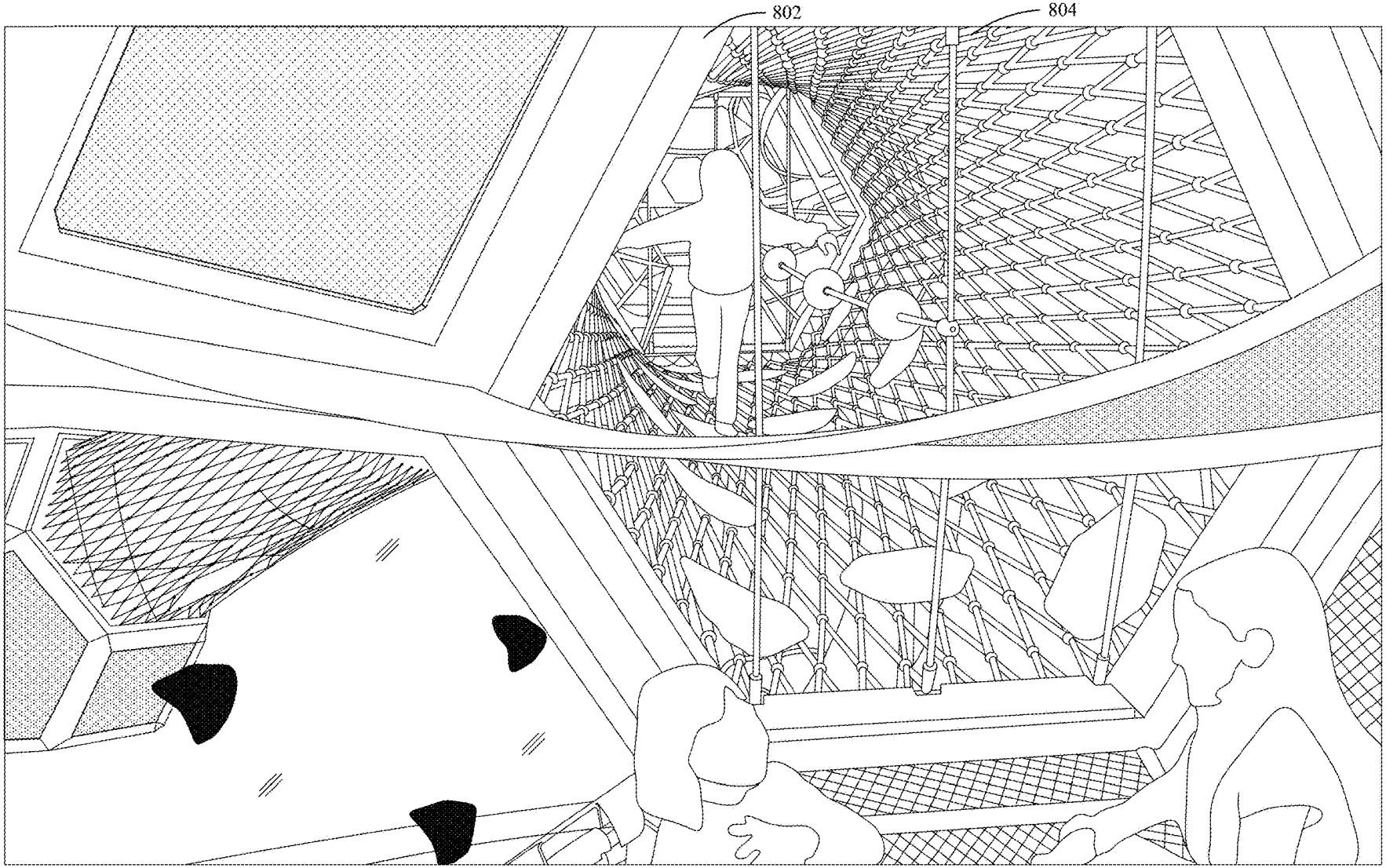
FIG. 8 is a perspective view from the inside of truncated octahedron.

FIG. 8 is a perspective view from the inside of a shape 802, again assumed for illustrative purposes to be a truncated octahedron. From this view, the internal components of an example tunnel 804 are visible. As is shown, a person is able to climb out of a shape, through a tunnel (which this time is a rope style substantially enclosed bridge tunnel), and into another shape.

Figure 9:
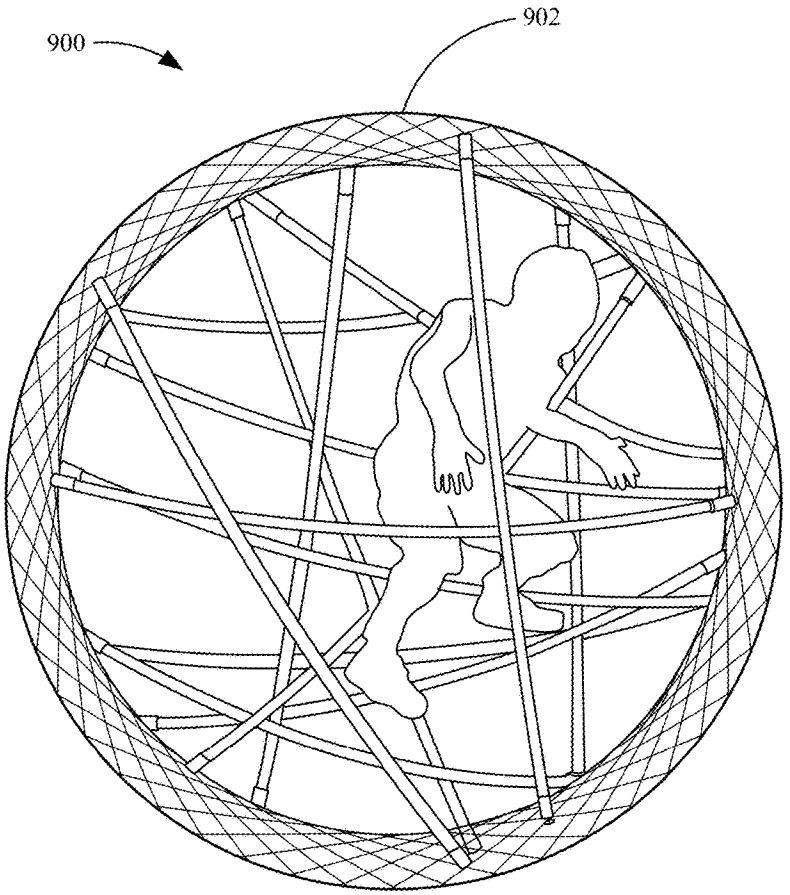
FIG. 9 is a perspective inside view from within a component of an example play system.

FIG. 9 is a view showing another example of what crossing a bridge between shapes illustratively looks like from an inside view. In this case, the tunnel 900 has a network of connected lines as an outer shell 902, illustratively similar to what is shown in FIG. 8. But in the case of FIG. 9, there are a series of climbing obstructions to maneuver through while moving through the tunnel.

Figure 10:
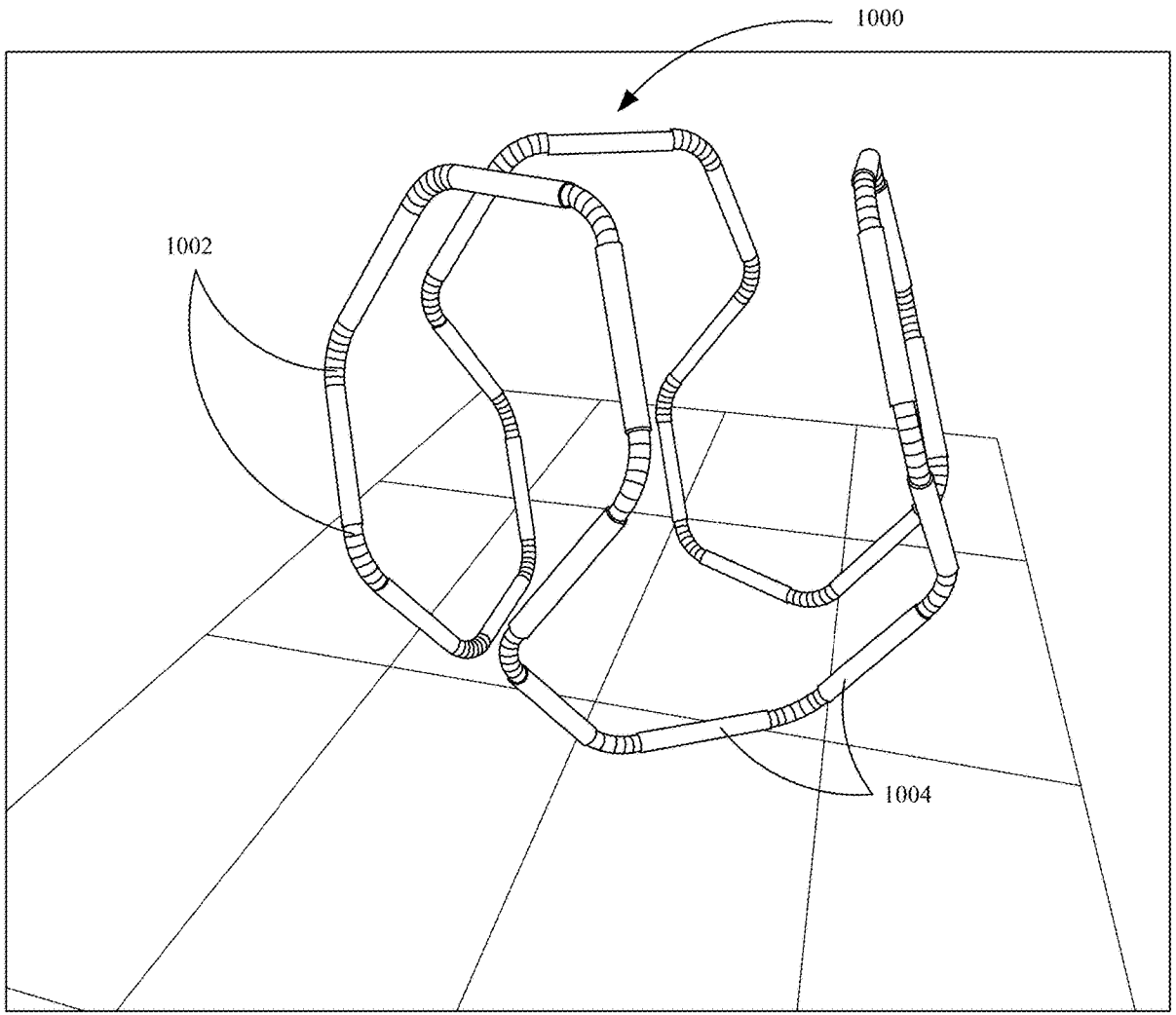
FIG. 10 is a perspective view of a frame.

FIGS. 1, 2, 3, 4, 5, 6 and 7 show the shape components, illustratively but not necessarily truncated octahedrons, from an outer perspective without any detail provided in terms of the inner structure. FIG. 10 is a perspective view showing an embodiment of an inner frame 1000. This frame 1000 is for the truncated octahedron shape embodiment. Frame 1000 includes a plurality of elbows 1002 and straight sections 1004. In other examples, where truncated octahedron 1000 is replaced with a different shape, a different configuration of elbows 1002 and a different configuration of straight portions 1004 is likely to be required. In one embodiment, but not by requirement, portions 1002 and 1004 are all individual pieces connected to one another so as to form the continuous frame shown in FIG. 10. In this regard, putting the frame together is similar to putting together a child's slot car racetrack, in that the pieces should be assembled in the right order to create a particular desired overall frame shape. In one example, as shown in FIG. 10, each straight section 1004 is consecutively interconnected with each elbow section 1002, one after the other, in a single line, to form a continuous frame loop (e.g., frame 1000). Each straight section 1004 can be interconnected end-to-end with each elbow section 1002 to form the continuous frame loop. For instance, the continuous frame loop forms the particular desired overall frame shape. In one example, the continuous frame loop has a beginning and an end, with a respective straight section 1004 forming the beginning of the continuous loop and a respective elbow section 1002 forming the end of the continuous loop. That being said, it is within the scope of the present invention to put pieces together in any combination and attach panels, edge pieces, joint pieces so as to create unique play structures having any of a variety of different overall shapes. Parts of a shapes can be joined together in any combination to form play components, or parts from different shapes can all be combined to form different play components. Flexibility is a key attribute of the design. One can assemble all of the pieces to make the basic shape as intended, such as a truncated octahedron, or pieces can be combined differently to make different shapes, combinations of shapes, transitions between shapes, etc. And then panels, edge pieces, and joint pieces can be added in selectively to give the wonky a clean overall look and feel.

Figure 11:
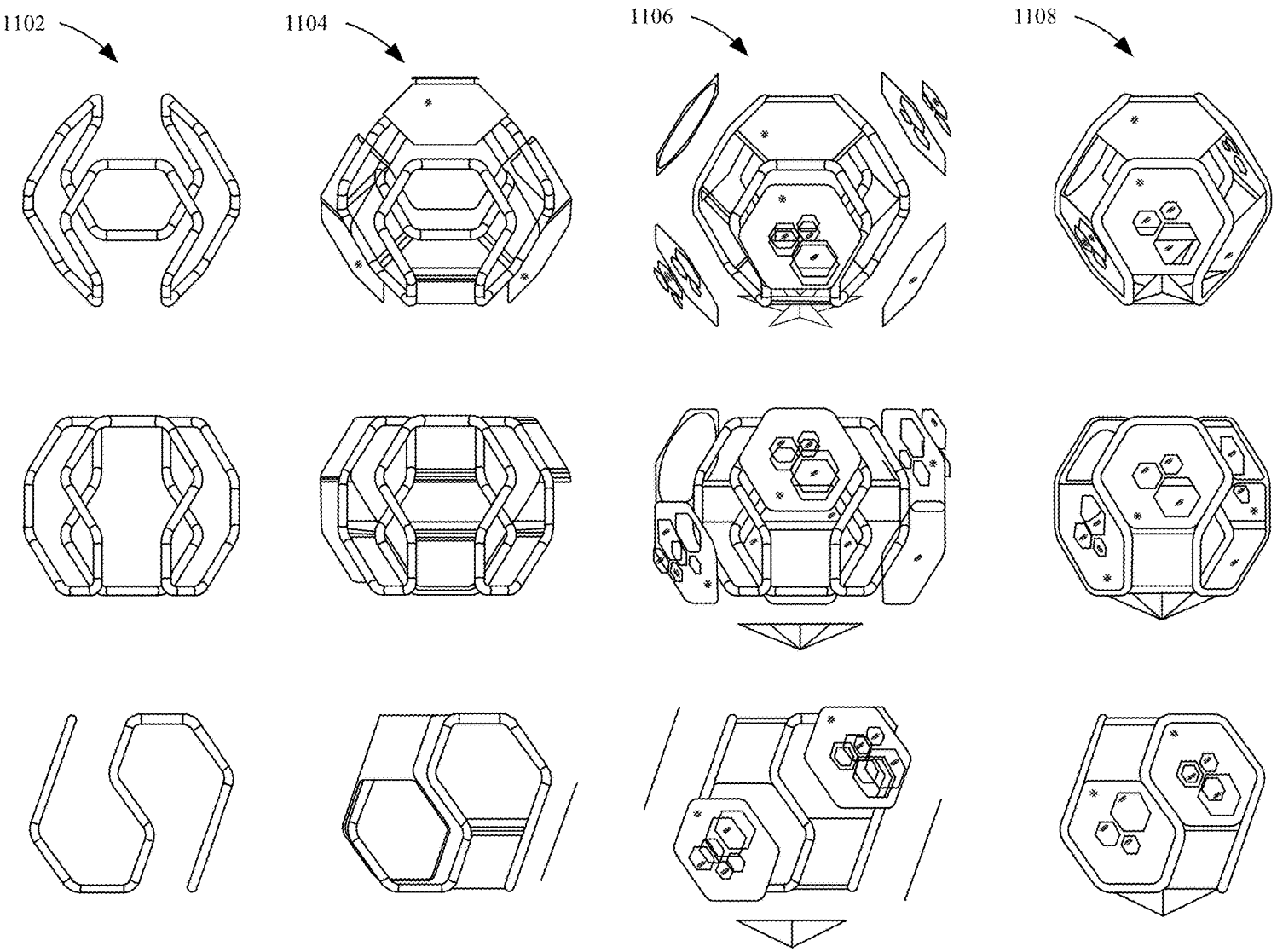
FIG. 11 is a variety of different views of a truncated octahedron configuration.

FIG. 11 is a series of views demonstrating the overall nature of an embodiment of the described play component manifested as the truncated octahedron shape. Column 1102 shows an empty frame of the truncated octahedron from three different views. Column 1104 shows panels progressively added to the frame. Column 1106 shows additional panels being placed on the frame. Column 1108 shows the panels installed on the base frame. In other examples, there may be different panels that couple to the base frame, other than those shown. Also, in other examples, there may be different geometric shapes utilized other than a truncated octahedron.

Figure 12:
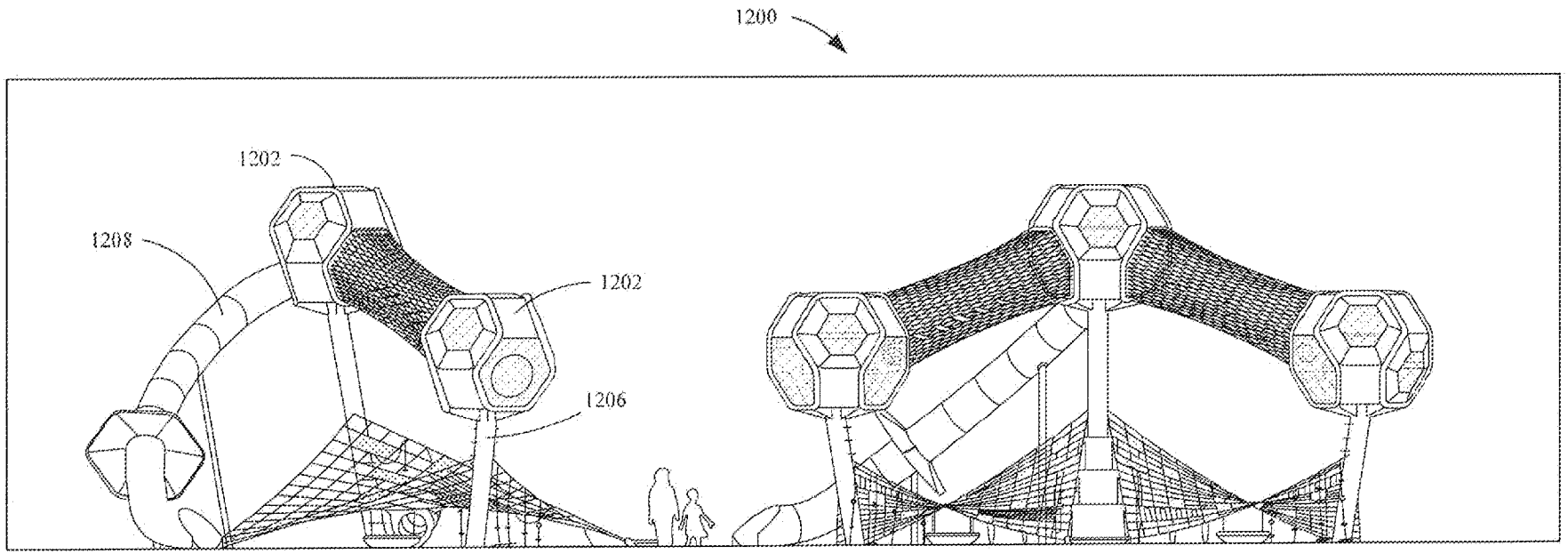
FIG. 12 is a perspective view of an example play system.

FIG. 12 is a perspective view of an example play system 1200. In this case, a frame similar to frame 1000 in FIG. 10 is shown as part of shapes 1202, which are attached to tunnel 1208, support 1206, and other play features in the overall play environment. A purpose of FIG. 12 is to emphasize the fact that adding edge and joint pieces is not a strict requirement. Neither is covering every surface a requirement. Eliminating some panels creates more entry/exit and climbing possibilities. It also creates a different overall aesthetic quality.

Figure 13:
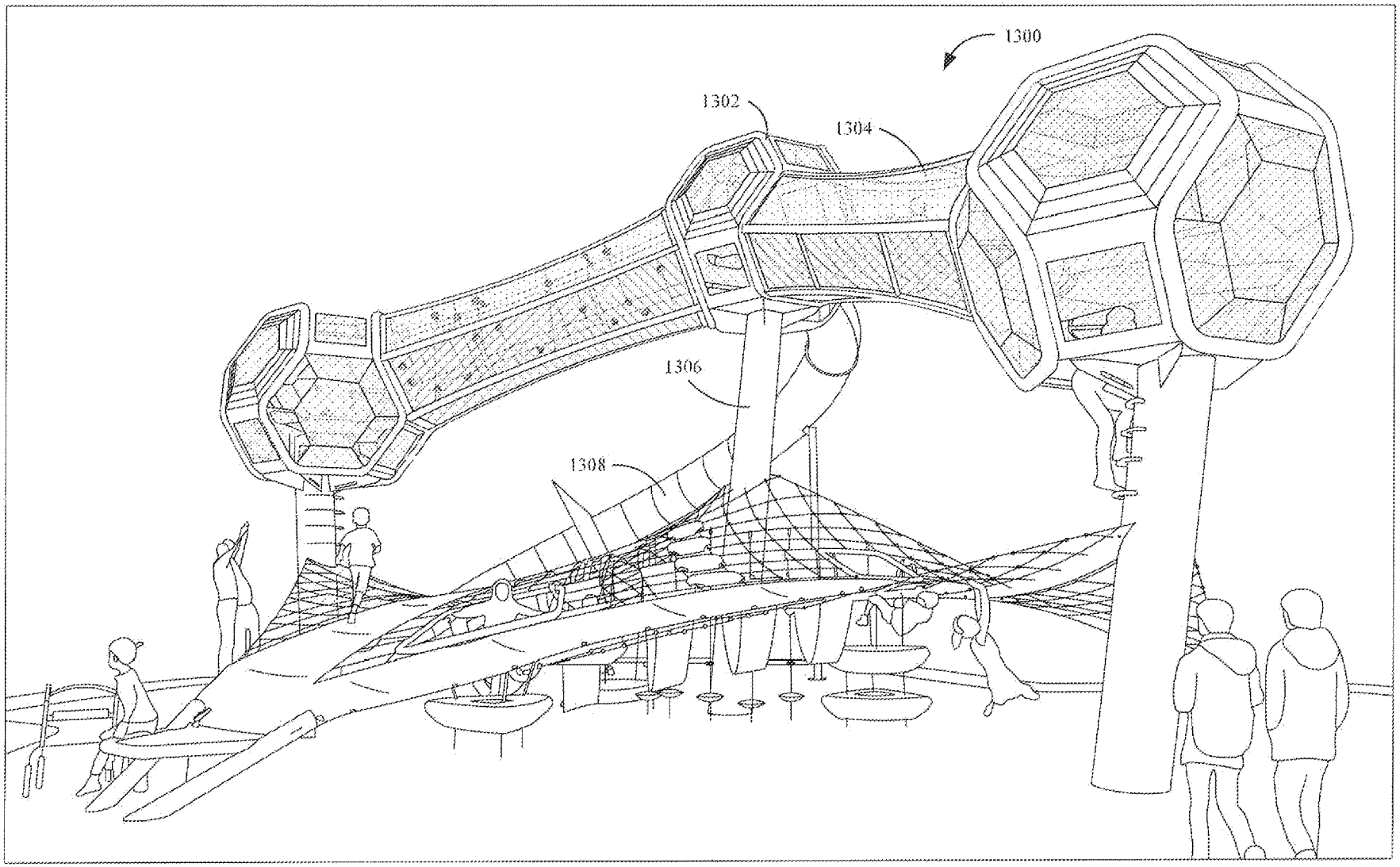
FIG. 13 is a perspective view of an example play system.

FIG. 13 is a perspective view of an example play system 1300. A frame similar to frame 1000 in FIG. 10 is again shown as part of shapes 1302 (only one of which is labeled). The shapes are attached to a tunnel 1304, support 1306, slide 1308, and other play features in the overall play environment. A purpose of FIG. 13 is to emphasize the fact that a panel added to a shape frame need not necessarily be flat. Some panels in FIG. are shown as including a textured quality that causes them to extend out from the frame. Instead of convex, they could just as easily be concave, relative to the play space inside the shape.

Figure 14:
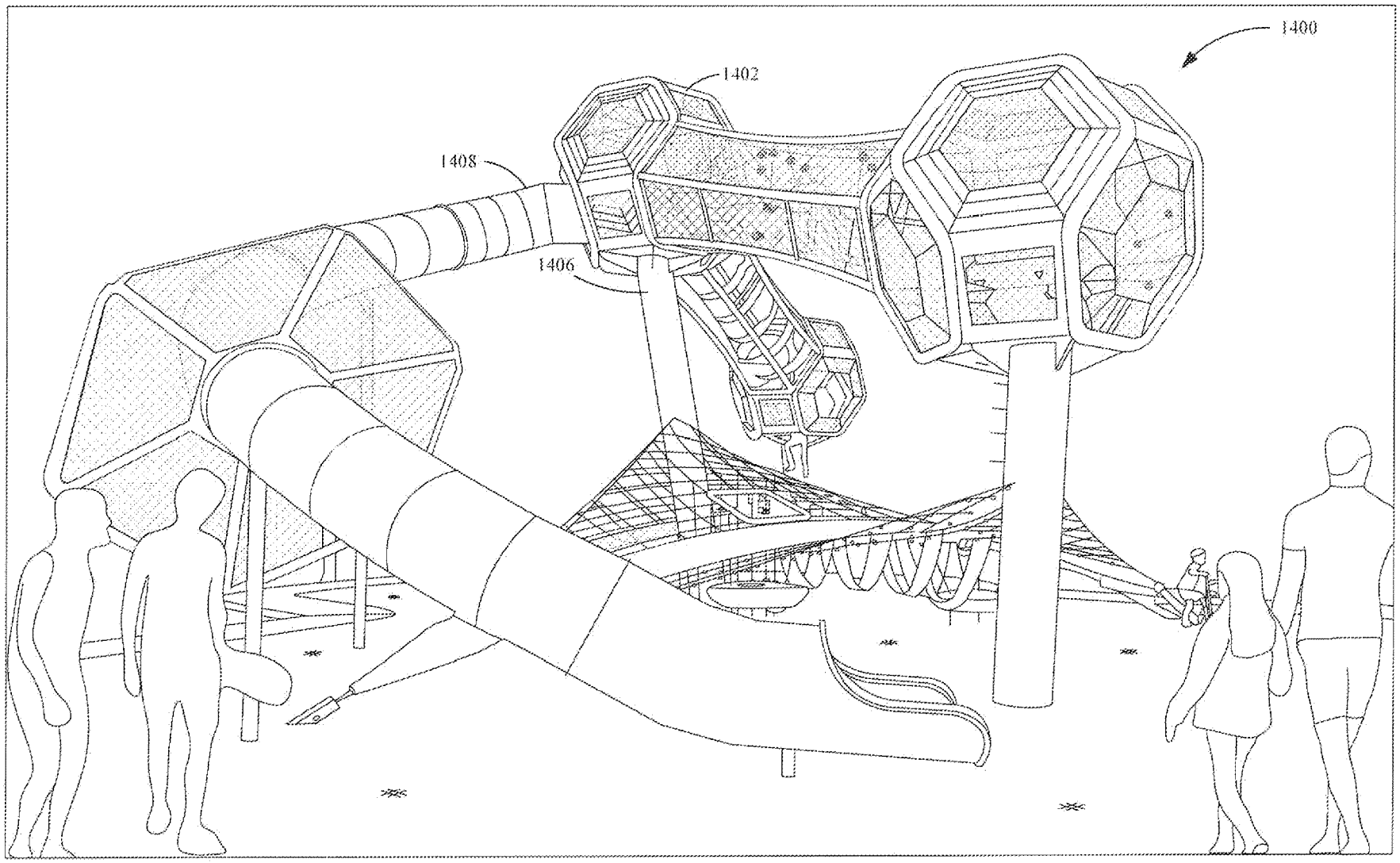
FIG. 14 is a perspective view of an example play system.

FIG. 14 is a perspective view of an example play system 1400. A frame similar to frame 1000 in FIG. 10 is again shown as part of shapes 1402 (only one of which is labeled). The shapes are attached to a tunnel 1408, support 1406, slide not labeled, and other play features in the overall play environment. A purpose of FIG. 14 is to emphasize the flexibility enabled by the shapes in terms of creating numerous different play configurations.

Figure 15:
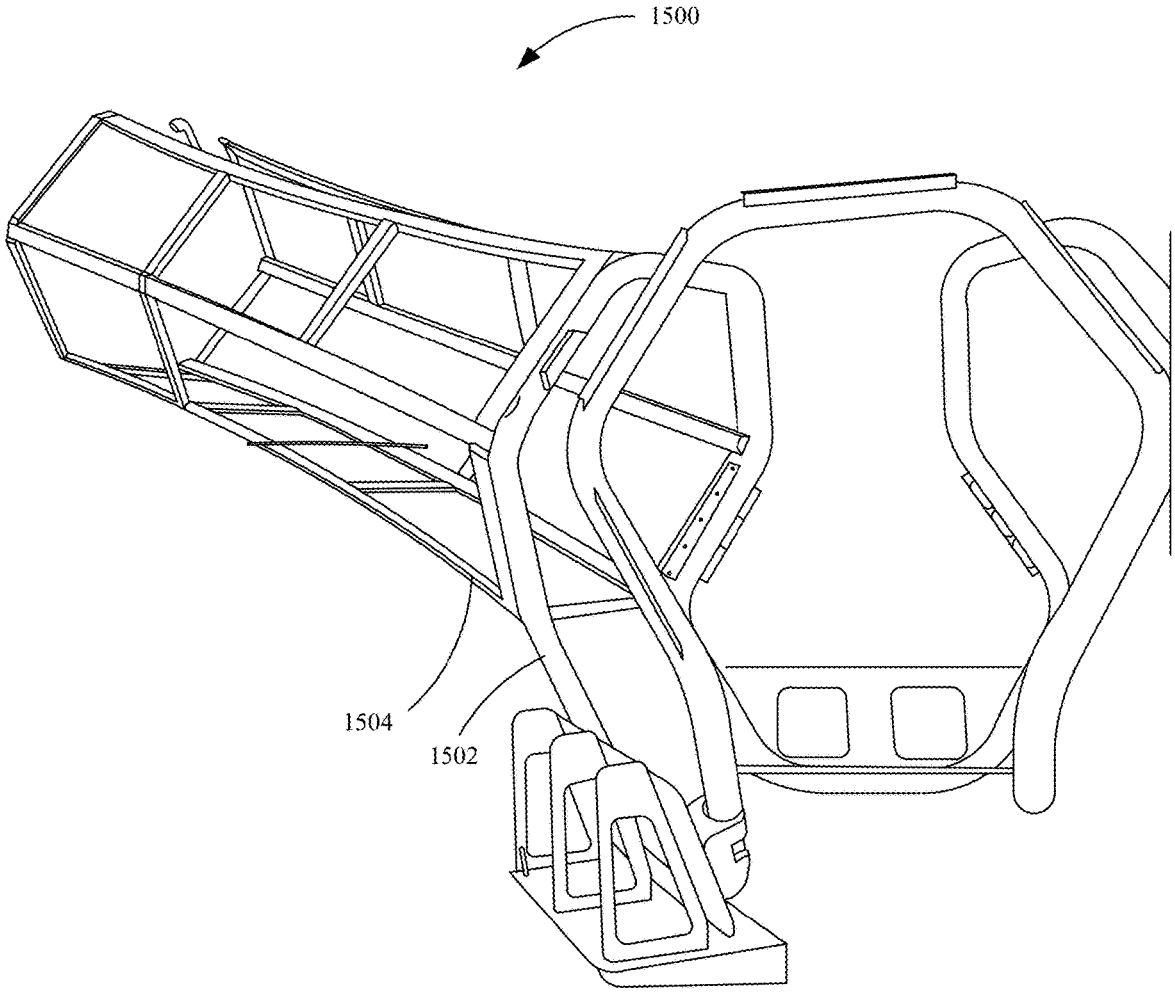
FIG. 15 is a perspective view of part of an example play system.

FIG. 15 is a perspective view of a portion 1500 of an example play system. A purpose of FIG. 15 is to demonstrate how a frame 1502, similar to frame 1000 in FIG. 10, is positioned in a play area and then built around during assembly. A partially assembled tunnel 1504 is shown connected to the frame.

Figure 16:
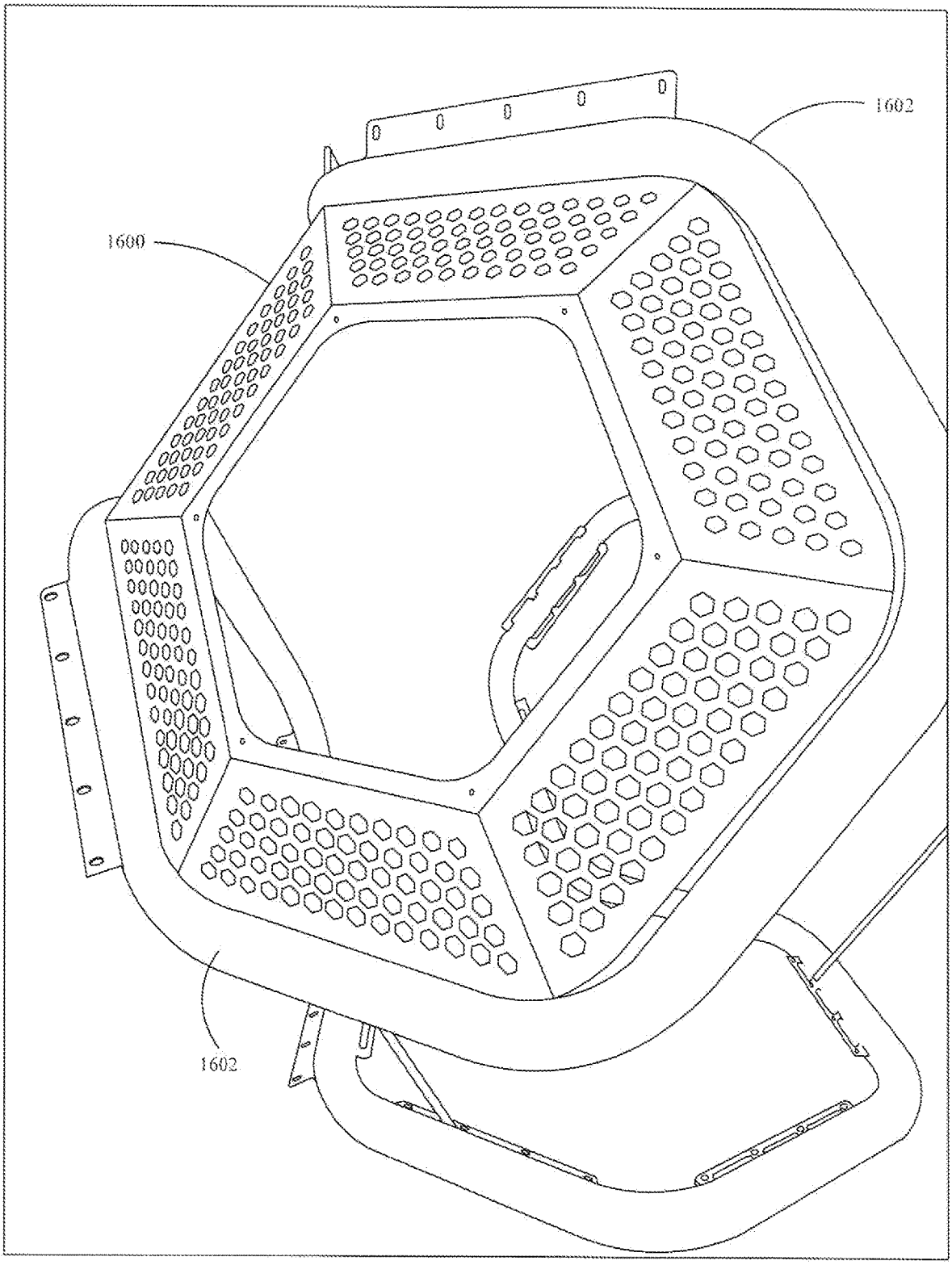
FIG. 16 is a perspective view of an example of a panel.

FIG. 16 is a perspective view of an example of a panel 1600 that extends through an opening formed in a frame 1602. The frame 1602 is illustratively similar to the frame 1000 shown in FIG. 10. A purpose of FIG. 16 is simply to provide a closer up view of how a panel and the frame are integrated with one another, in accordance with one embodiment. The components shown in FIG. 16 are shown part way through an assembly of an overall play structure.

Figure 17:
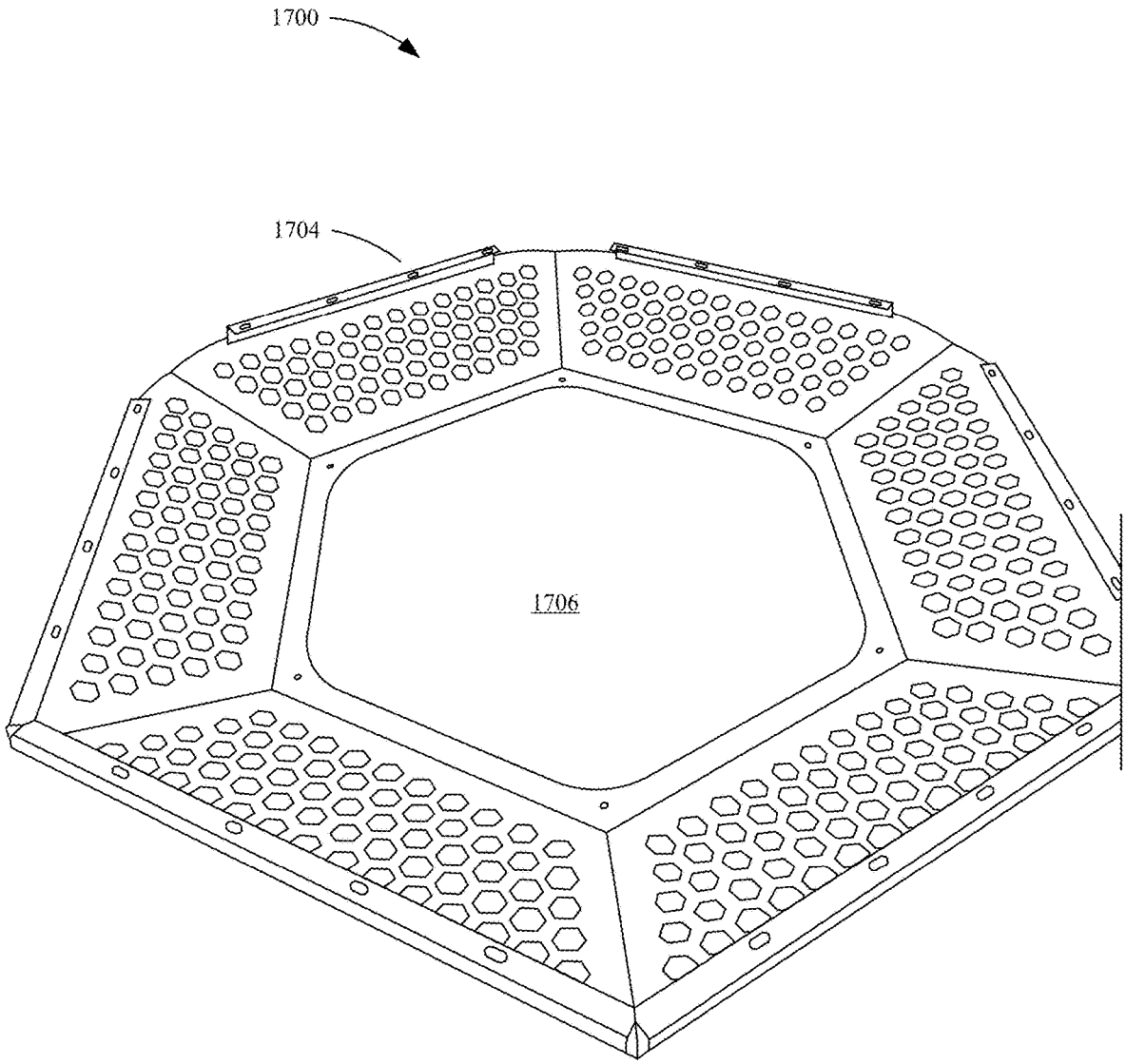
FIG. 17 is a perspective view of an example of a panel.

FIG. 17 is a perspective view of an example play system panel 1700. Panel 1700 includes attachment mechanisms 1704 that supports a connection of the panel to a frame, such as frame 1602 in FIG. 16 or frame 1000 in FIG. 10. This is just one example of a connection mechanism. Other mechanisms could just as easily be utilized. Panel 1700 includes a center opening 1706 formed in the panel. In one embodiment, this opening in the panel 1700 can be left open or filled with another component, such as a smaller sub-panel.

Figure 18:
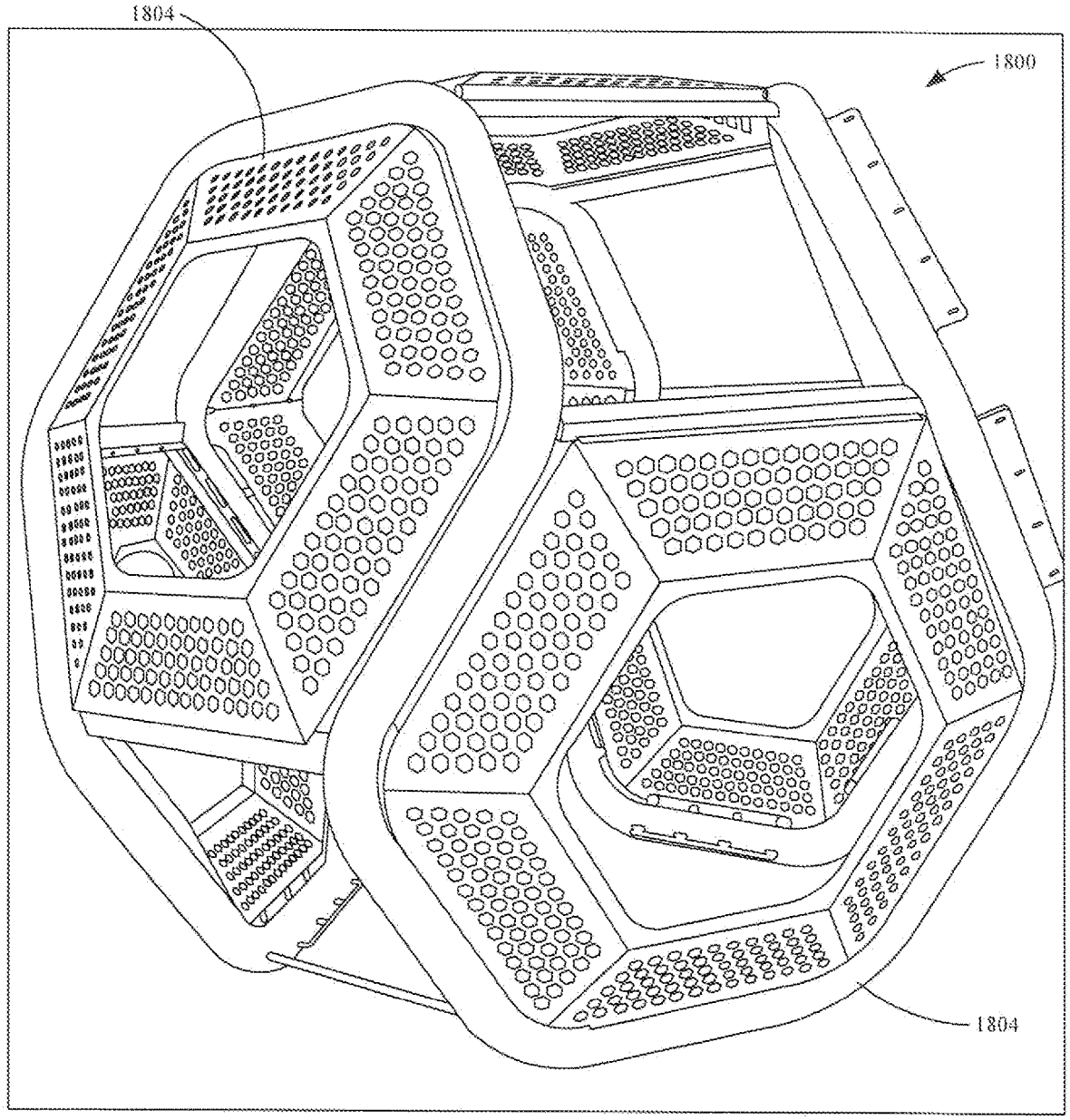
FIG. 18 is a perspective view of an example play system component.

FIG. 18 is a perspective view of an example play system component 1800. Play system component includes a frame similar to frame 1000 shown in FIG. 10. In this case a plurality of panels 1804 (only one has been labeled) has been attached so as to fill some but not all of the openings in the truncated octahedron shape. Panels 1804 are illustratively convex in that they extend away from the frame. Each panel 1804 includes an opening that is illustratively large enough for a user to pass through. Square areas in the frame have also been left open for access. Frame 1804 is shown as being "endless" in that joints between pieces of the frame have been concealed. They can be completely concealed, partially concealed, or not at all concealed without departing from the scope of the present invention.

Figure 19:
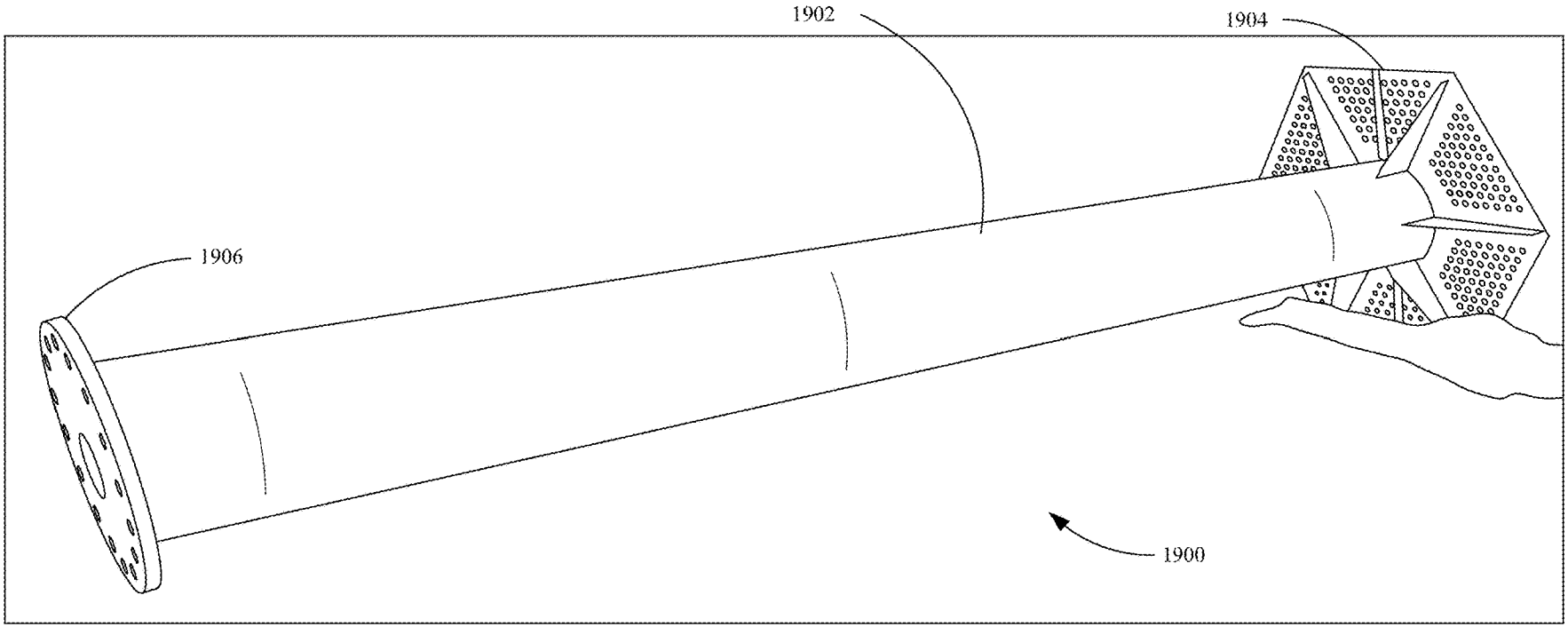
FIG. 19 is a perspective view of an example play system component.

FIG. 19 is a perspective view of an example play system component 1900. Play system component 1900 is a support structure, for example, support structure 206 from FIG. 2. Support structure 1900, as shown, includes an upright 1902, a component mount 1904 and a base 1906. Upright 1902 can be sized to accommodate integration into any height of a play system. Mount 1904 allows for connection of playground components to support structure 1900, for example, truncated octahedron 1800.

Figure 20:
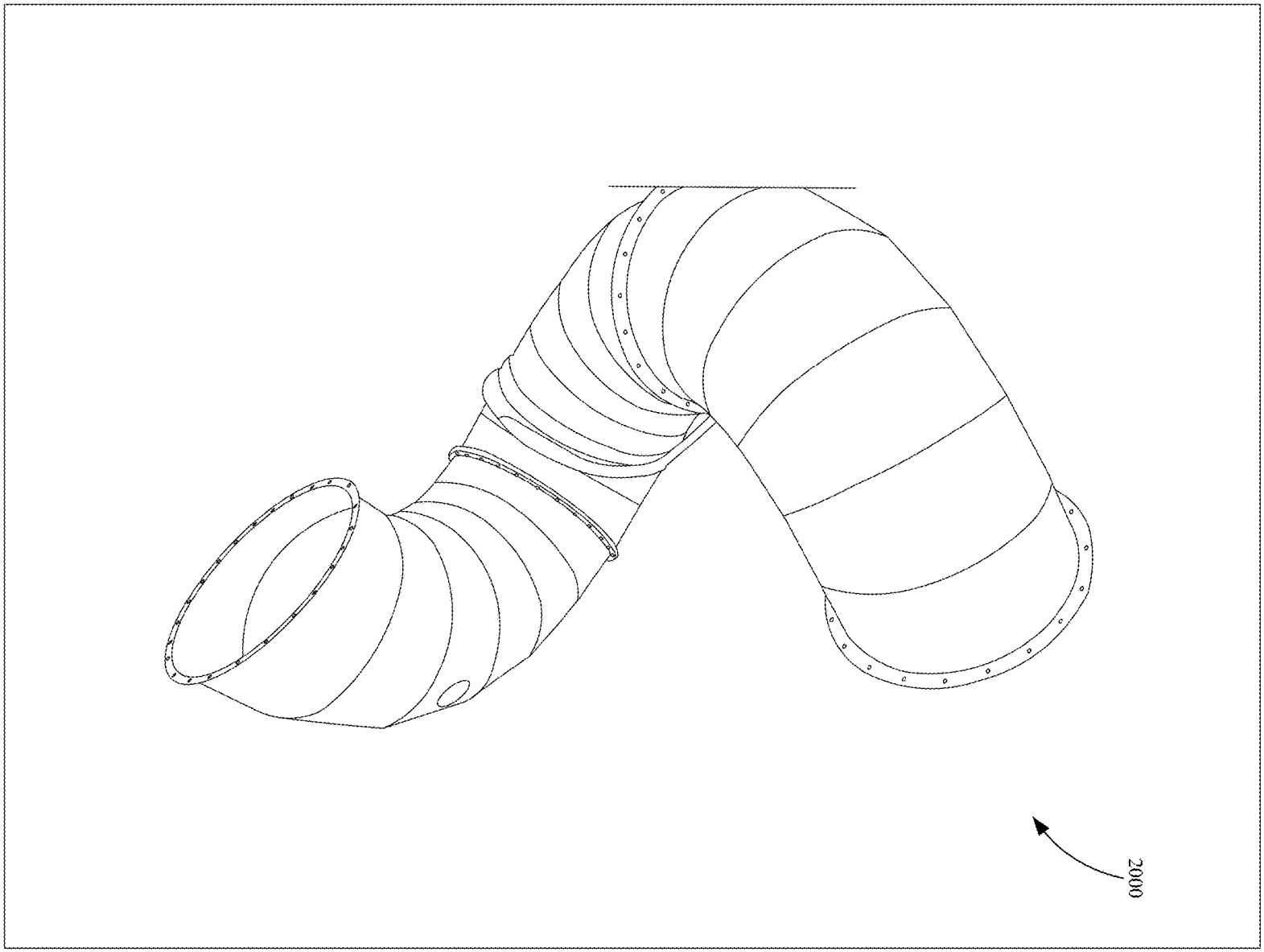
FIG. 20 is a perspective view of an example play system component.

FIG. 20 is a perspective view of an example play system slide 2000. Play system slide 2000 can be coupled to other components of a play system. For example, with reference to FIG. 17, slide 2000 is in one embodiment coupled to panel 1704 and aligned with opening 1706.

One skilled in the art will appreciate that the modular nature of the play components described here enables substantial creativity in the design and configuration of playground systems even after the components have already been manufactured. Indeed, two play systems need not ever be exactly the same, if desired. Some examples will now be provided.

Figure 21:
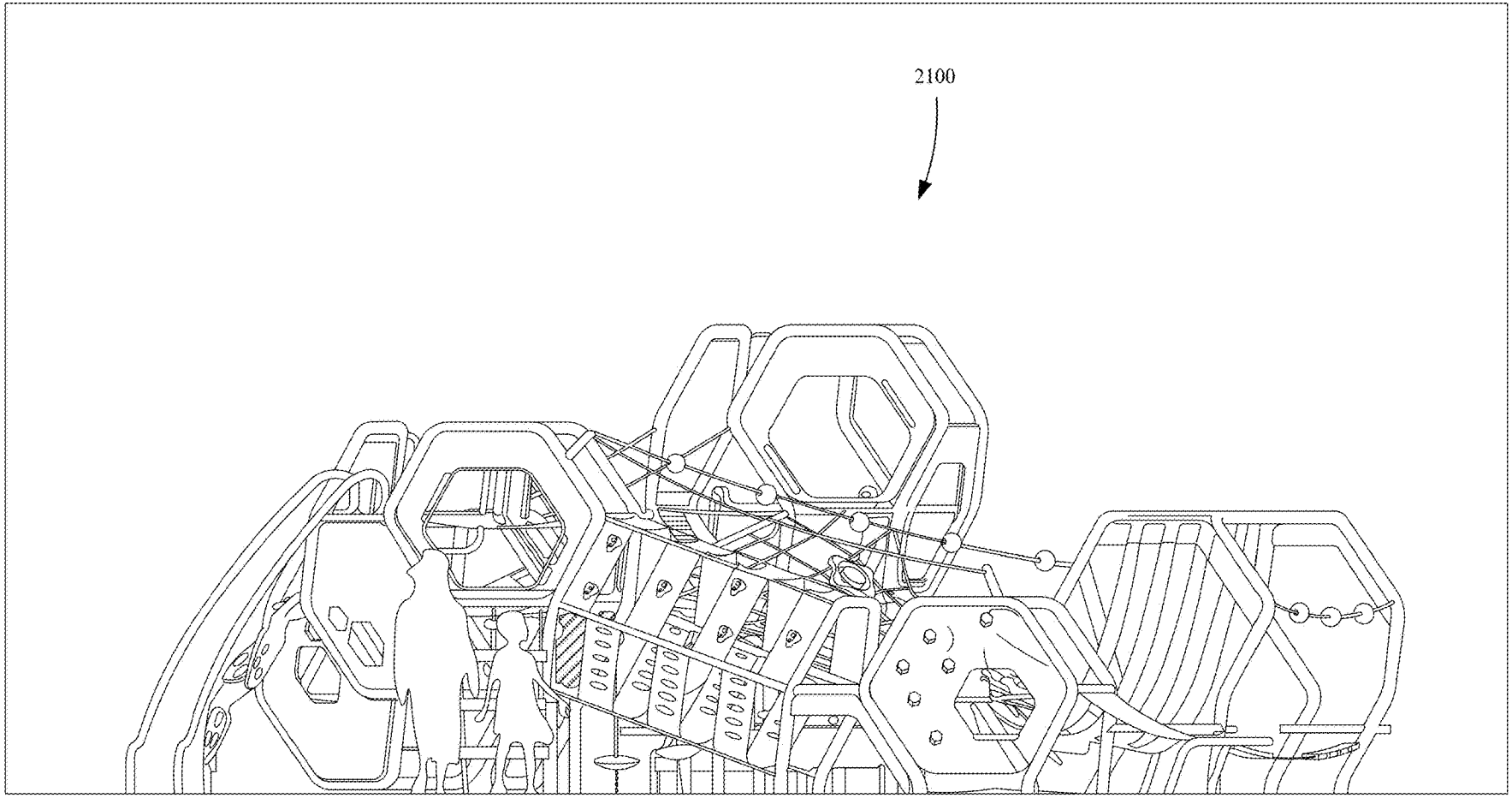
FIG. 21 is a perspective view of an example play system.
Figure 22:
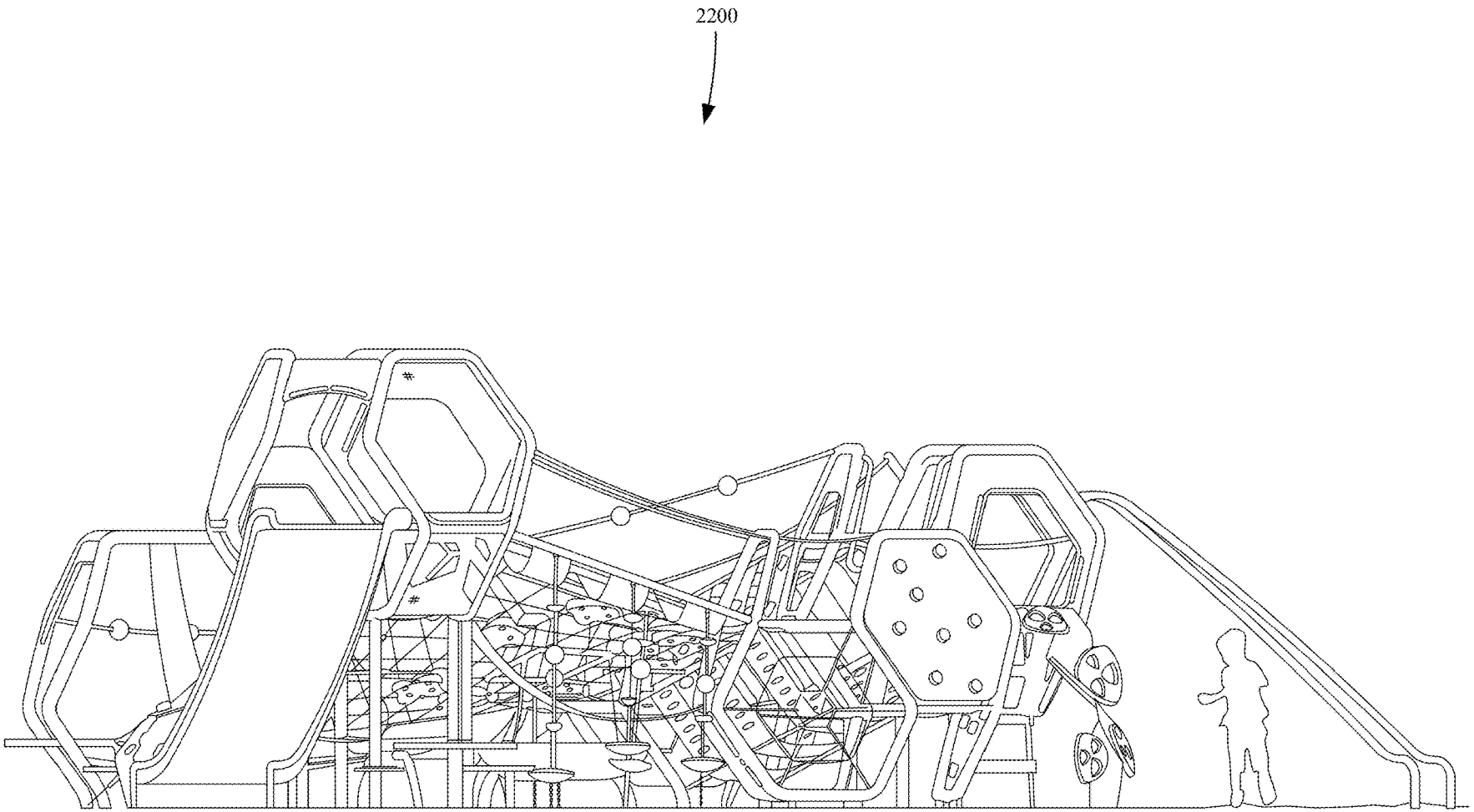
FIG. 22 is a perspective view of an example play system.
Figure 23:
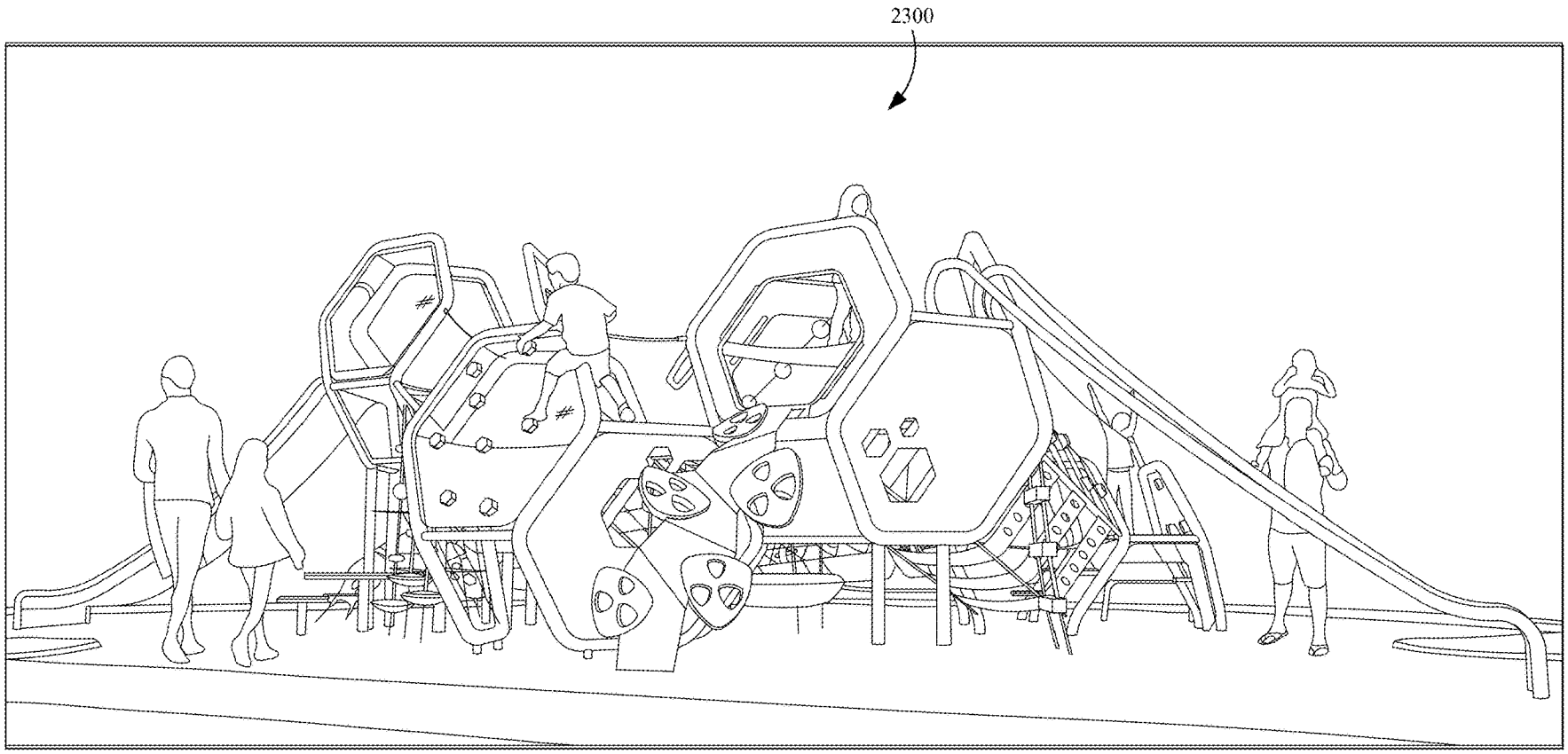
FIG. 23 is a perspective view of an example play system.
Figure 24:
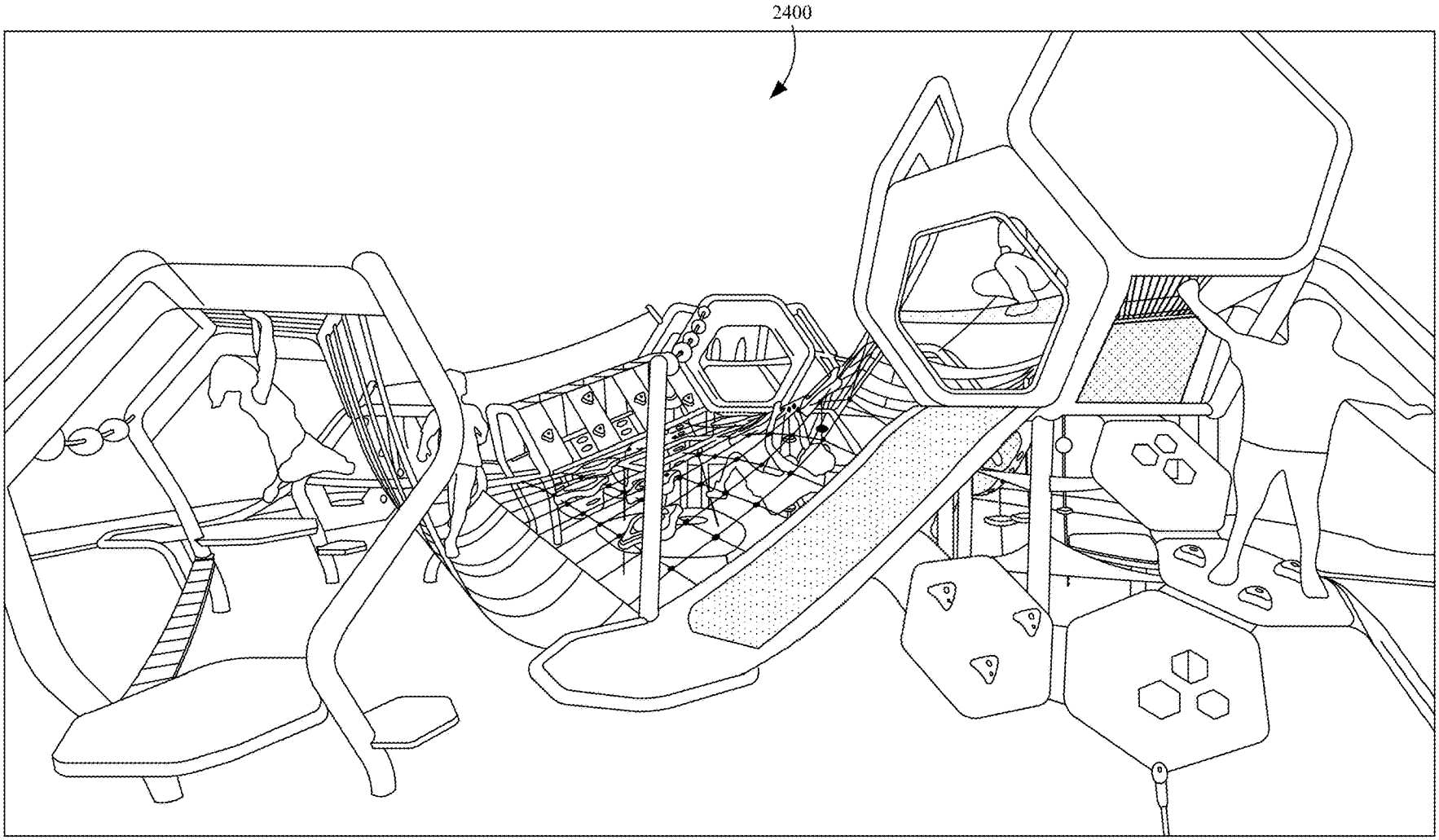
FIG. 24 is a perspective view of an example play system.

FIG. 21 is a perspective view of an example play system 2100. This Figure demonstrates how even parts of shapes and frames can be integrated into a playground design. Some frames can be proximate to the ground while others are raised. FIG. 22 is a perspective view of an example play system 2200 and demonstrates how some portions of the frame can be left open while others are filled or connected to play components. FIG. 23 is a perspective view of an example play system 2300 and demonstrates how designs can be tailored to be age specific, in this case perhaps for a younger age group. FIG. 24 is a perspective view of an example play system 2400 and demonstrates how it is not necessary for shapes to be strictly maintained. Curves and straight frame pieces can be combined to form extensions and additions to shapes and partial shapes.

Figure 25:
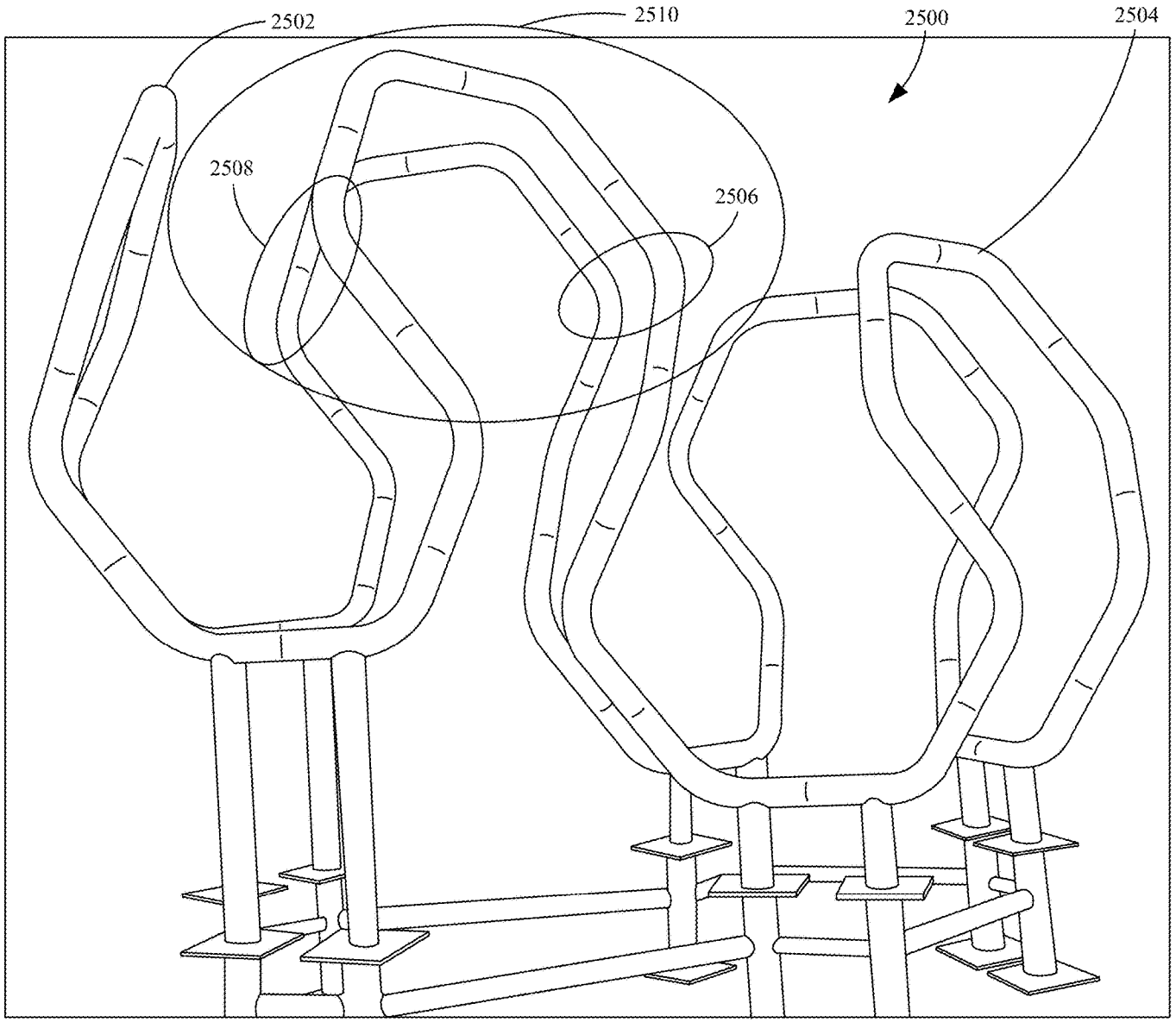
FIG. 25 is a perspective view of an example play system.

FIG. 25 is a perspective view of an example play system 2500. Play system 2500 includes a first partial shape 2502 (illustratively part of a truncated octahedron) integrated with a similar second shape 2504 (illustratively also part of a truncated octahedron). Shapes 2502 and 2504 are similar to shape 1502 of FIG. 15 except at portions 2508 and 2506, respectively. At portions 2508 and 2506, a connection piece 2510 is added to connect shapes 2502 and 2504, such that a larger, substantially endless frame connecting two shapes is formed. Pieces, panels and components can be attached to this or any other combination configuration to create even more possibilities in terms of play system design possibilities.

Figure 26:
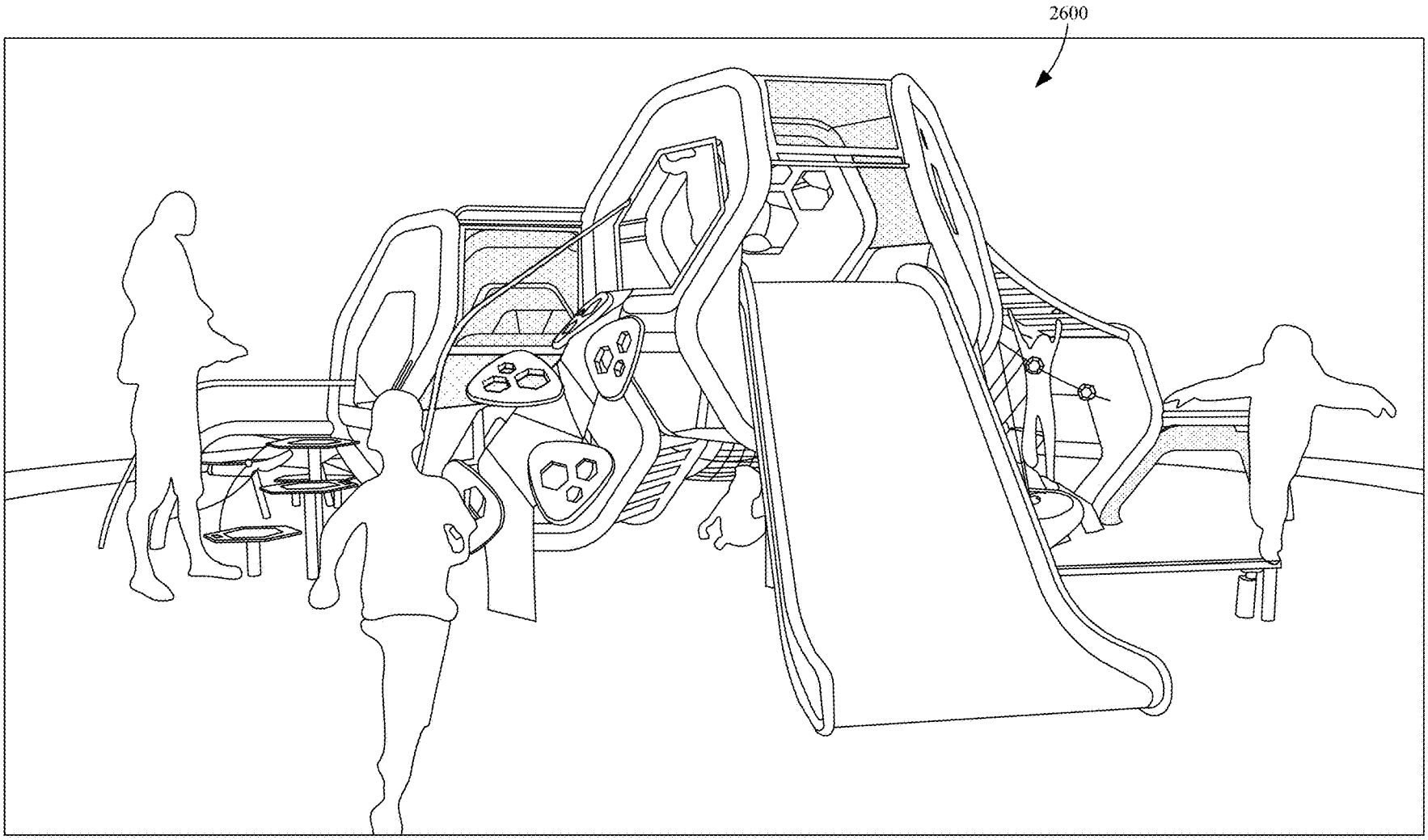
FIG. 26 is a perspective view of an example play system.
Figure 27:
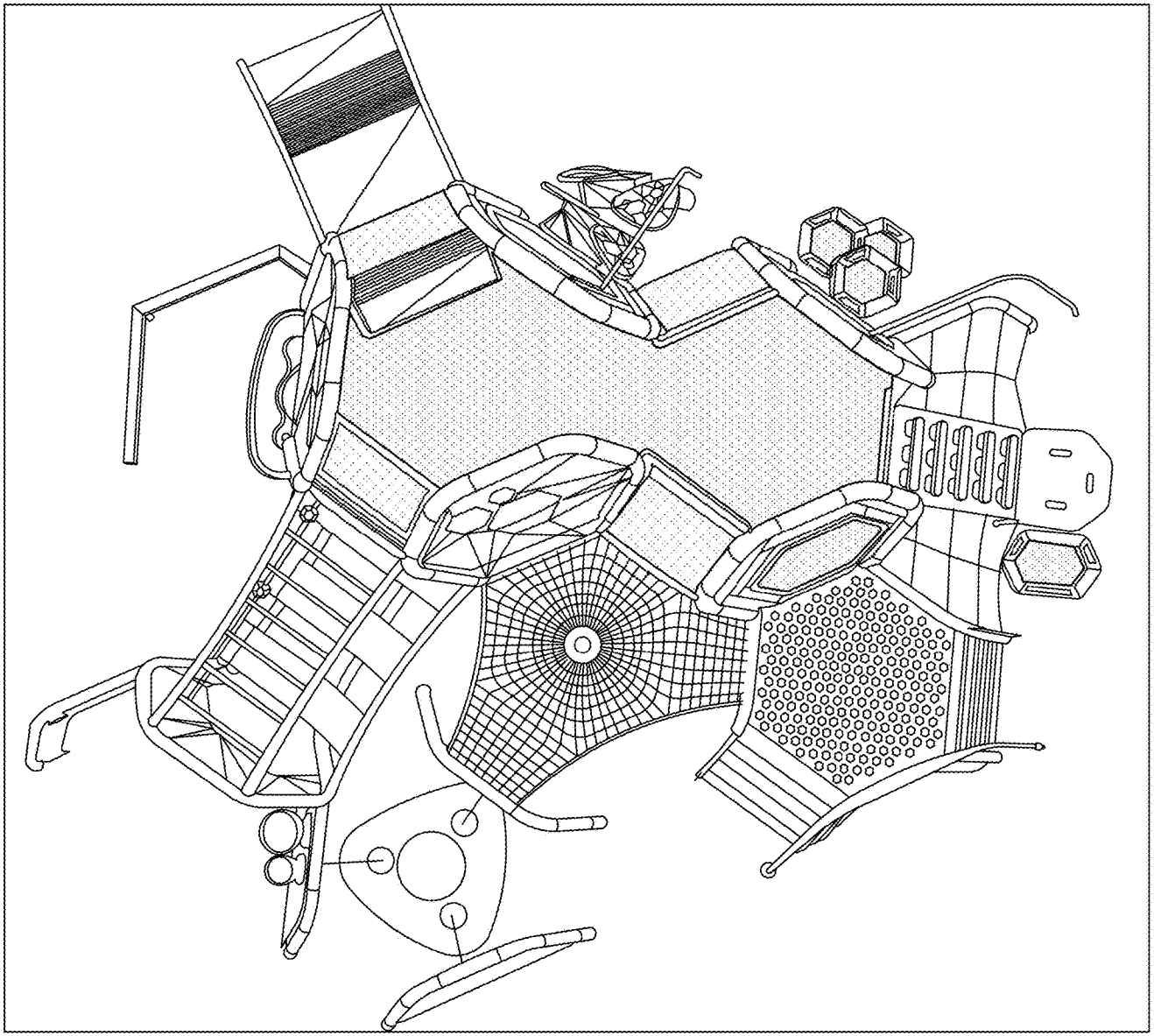
FIG. 27 is a perspective view of an example play system.
Figure 28:
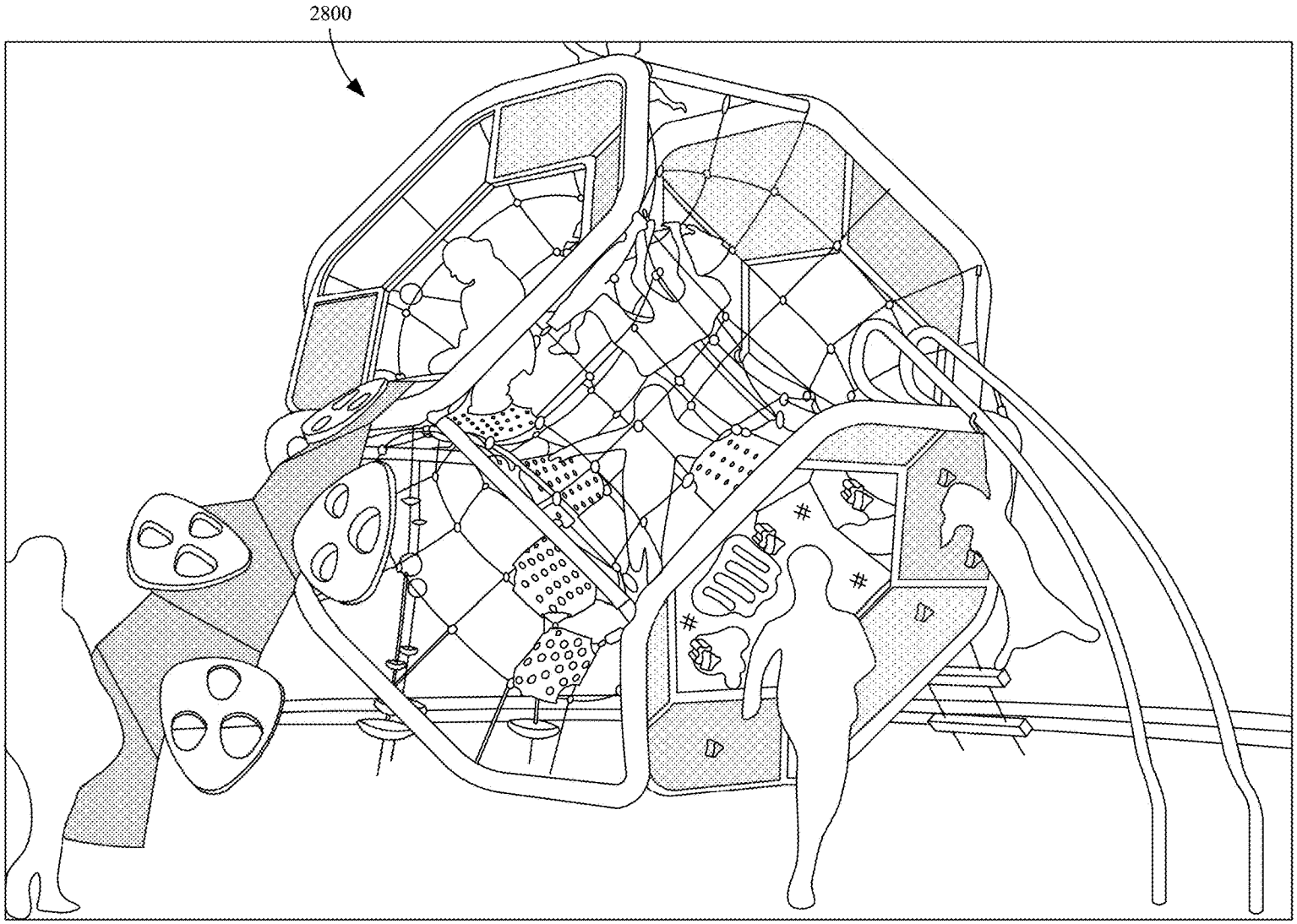
FIG. 28 is a perspective view of an example play system.

FIGS. 26 and 27 are perspective views of example play system 2600 and 2700 that incorporates multiple combined shapes flowing into one another, such as was described in relation to FIG. 25. FIG. 28 is a perspective view of an example play system 2800, demonstrating that the size of the shapes is not necessarily fixed. They can be very big or very small.

Figure 29:
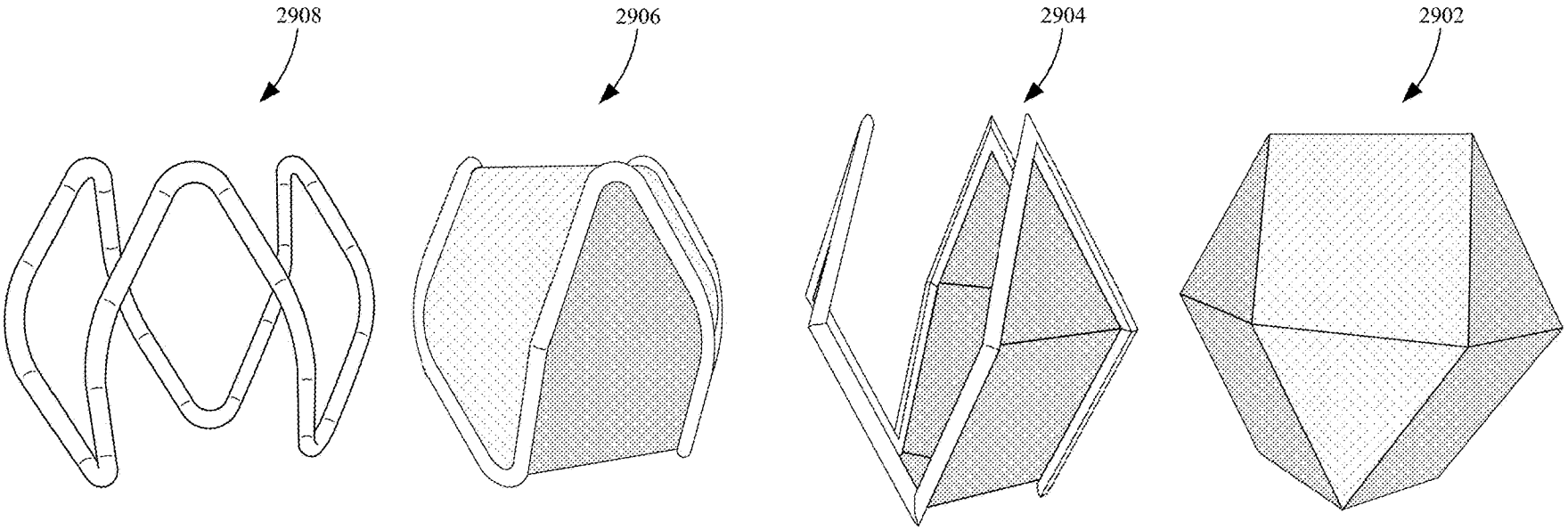
FIG. 29 is a perspective view of an example play system component.

Up to this point, most of the example that have been provided have been in the context of a truncated octahedron shape. It is to be emphasized that the scope of the present invention is not so limited. For example, another polyhedron can be converted into a similar component. FIG. 29 demonstrates how a similar but different frame can be derived from a different polyhedron 2902. A concept for frame 2904 is illustratively derived from polyhedron 2902 by mimicking a continuous path along the straight lines so as to remove half of the overall shape. The concept frame 2904 is then smoothed into a second concept frame 2906, which essentially involves rounding off the tight corners. A final frame 2908 is then completed by smoothing out the joints to accommodate panel attachment, etc. The final frame 2908 can be incorporated into play structures in a manner similar to that described in relation to frame 1000 of FIG. 10 and elsewhere in the present description.

Figure 30:
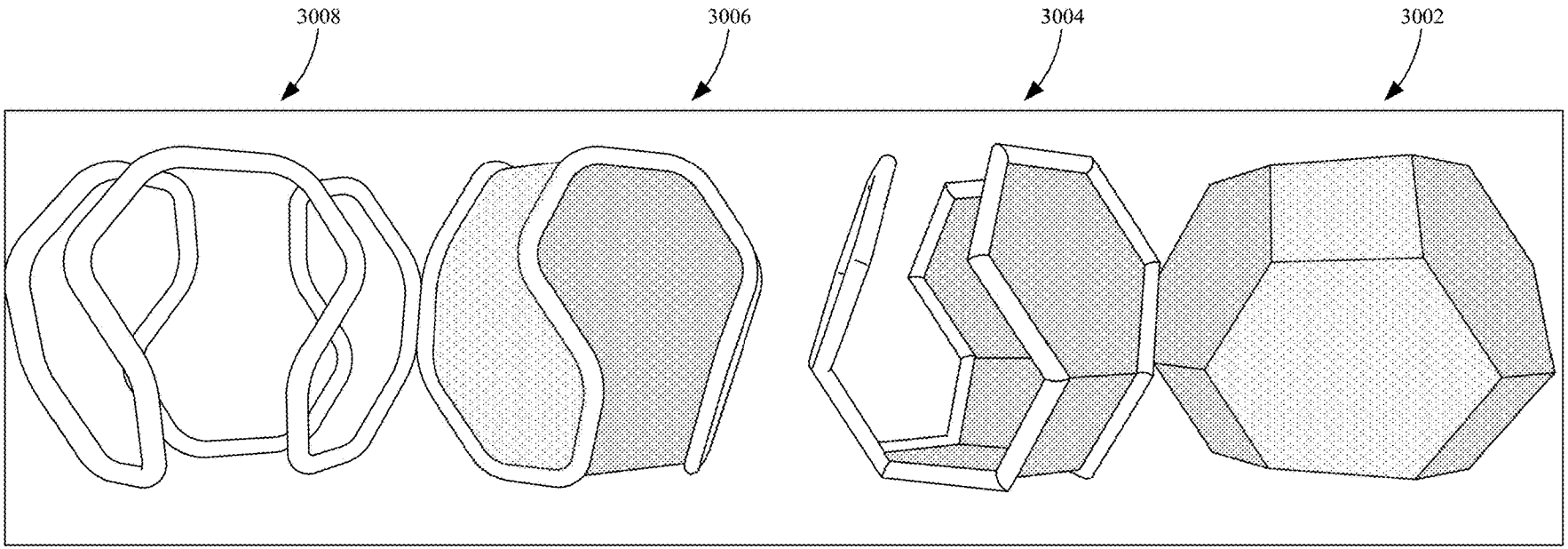
FIG. 30 is a is perspective view of an example play component.
Figure 31:
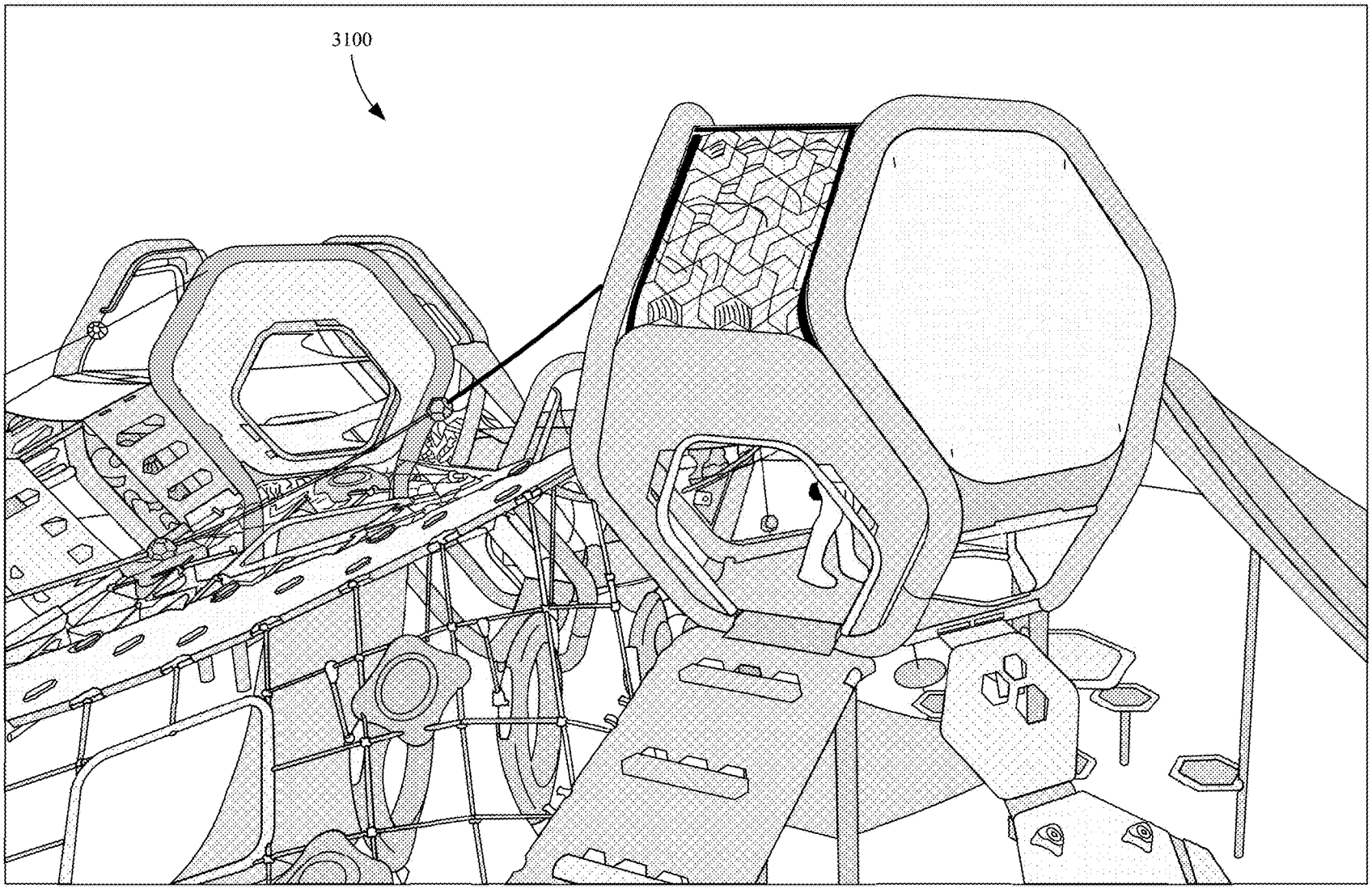
FIG. 31 is a perspective view of an example play system.

FIG. 30 is another demonstration of how a similar but different frame can be derived from a different polyhedron 3002. A concept for frame 3004 is illustratively derived from polyhedron 3002 by mimicking a continuous path along the straight lines so as to remove half of the overall shape. The concept frame 3004 is then smoothed into a second concept frame 3006, which essentially involves rounding off the tight corners. A final frame 3008 is then completed by smoothing out the joints to accommodate panel attachment, etc. The final frame 3008 can be incorporated into play structures in a manner similar to that described in relation to frame 1000 of FIG. 10 and elsewhere in the present description. FIG. 31 is an example play system 3100 demonstrating an implementation of the different shape basis into a play structure.

Figure 32:
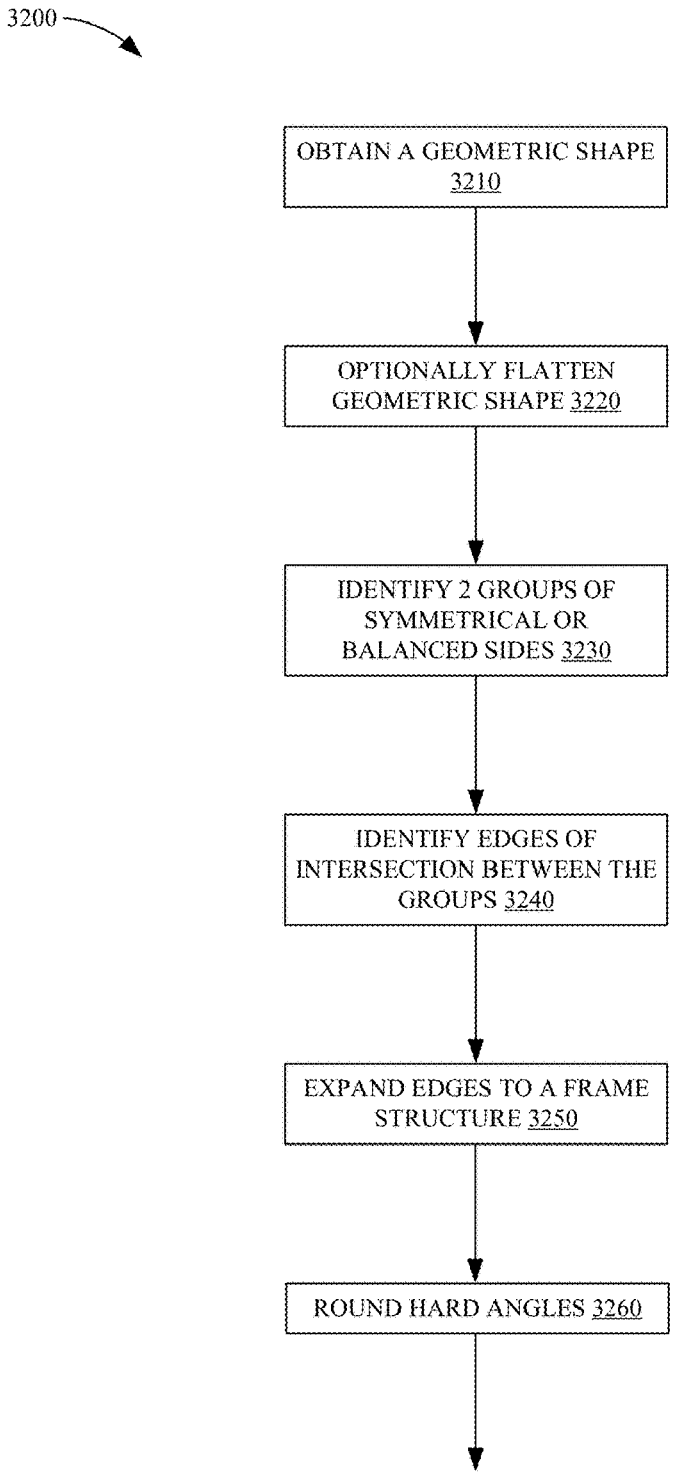
FIG. 32 is a perspective view of an example play system.

FIG. 32 is a flow diagram demonstrating an example of a process 3200 for deriving an "endless geometric frame" from many different polyhedrons. The concept of an endless geometric frame is one way to conceptualize the shape frames described herein. Process 3200 begins at block 3210 where a geometric shape is obtained. At block 3220, the geometric shape is illustratively flattened. At 3230, two groups of sides are selected or otherwise identified. Typically, the groups of sides will be symmetrical or otherwise balanced. At block 3240, edges of intersection between the groups of sides are identified. At block 3250, the identified edges are expanded to a frame structure. In one example, a frame structure includes a tubular structure. At block 3260 where the tubular structure is rounded. For example, any straight-line angle formed between edges can be radiused.

Figure 33:
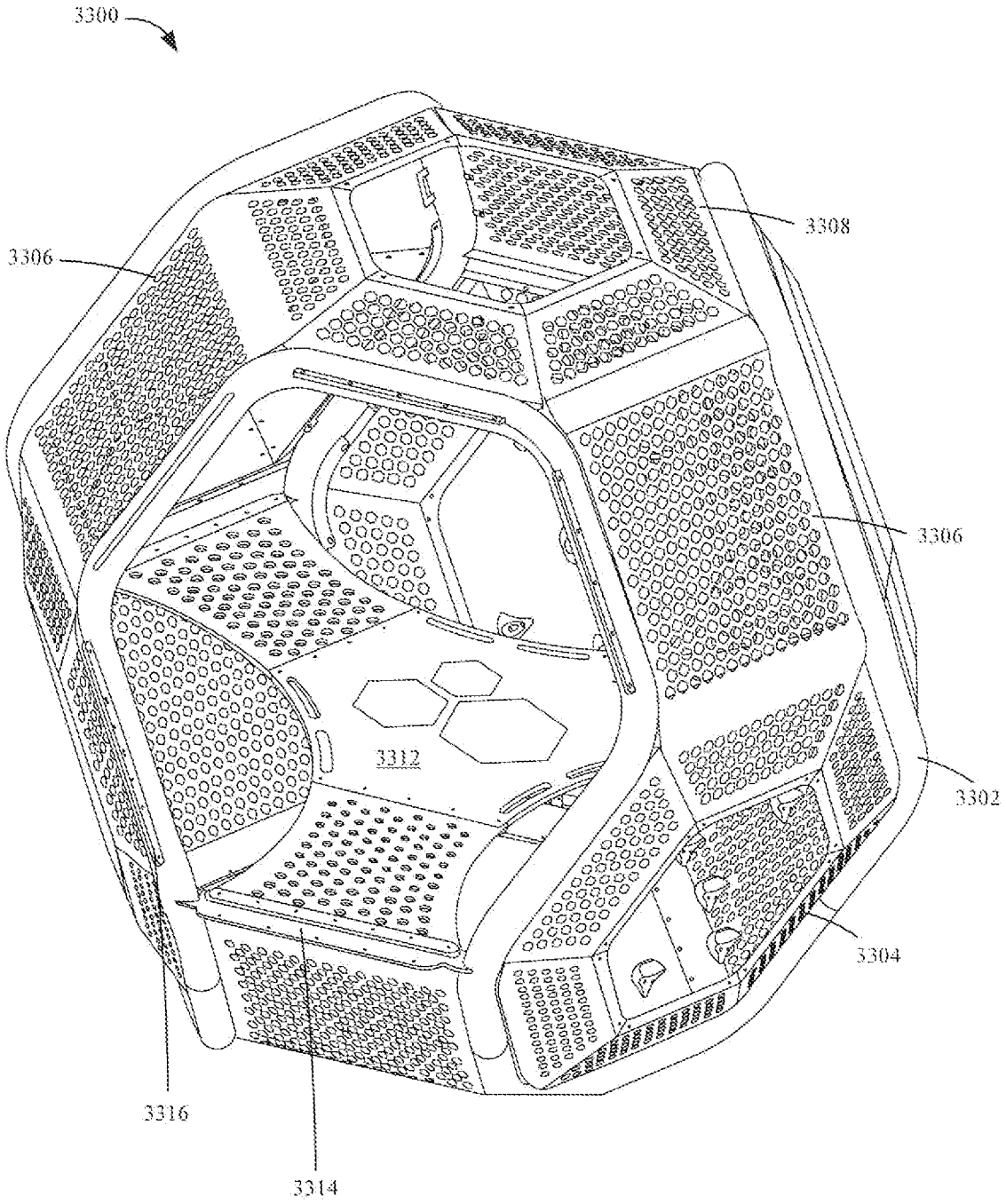
FIG. 33 is a perspective view showing an example playground structure.

Finally, FIG. 33 is a perspective view showing an example endless geometric frame assembly 3300. Assembly 3300 includes an endless frame 3302 that couples to a variety of different panels. As shown in FIG. 33, endless frame 3302 can include a series of individual tubular frame components consecutively joined together. Panels can be coupled to endless frame 3302 by couplers 3316 and 3314. In other examples, the panels can be coupled to frame 3302 in any other way.

Panel 3304 defines an entry way or window into endless frame 3302. Panel 3306 spans from one hexagonal face to another hexagonal face, filling a rectangular face. Panel 3308 defines a portion of an entry way or window into endless frame 3302. Panel 3312 defines a play surface within endless frame 3302. As shown, panel 3312 defines three holes for a user to climb onto panel 3312. In other examples, panel 3312 can define a fewer or greater number of holes or openings.

Although the present invention has been described with reference to preferred embodiments, workers skilled in the art will recognize that changes may be made in form and detail without departing from the spirit and scope of the invention.

What is claimed is:

1. A playground structure frame comprising:

a plurality of consecutively interconnected tubular frame components, wherein each tubular frame component, of the plurality of consecutively interconnected tubular frame components, is joined together, one after the other, in a single line, to form a continuous frame loop;

wherein the plurality of consecutively interconnected tubular frame components form an overall polyhedral frame shape of the playground structure frame; and wherein the overall polyhedral frame shape of the playground structure frame is in the shape of a truncated octahedron.

2. The playground structure frame of claim 1, wherein a joint is formed between a set of two consecutively interconnected tubular frame components of the plurality of consecutively interconnected tubular frame components that are joined together, one after the other, in the single line, and wherein all joints are at least partially concealed.

3. The playground structure frame of claim 2, wherein all joints are completely concealed.

4. The playground structure frame of claim 1, wherein each tubular frame component, of the plurality of consecutively interconnected tubular frame components, is one of:

a straight tubular frame component; or a curved tubular frame component.

5. The playground structure frame of claim 1, wherein a support structure is connected to the playground structure frame and causes the playground structure frame to be vertically offset from ground level.

6. A playground structure frame comprising:

a series of tubular straight frame components and a series of tubular elbow frame components, wherein each tubular straight frame component, of the series of tubular straight frame components, interconnects with a respective tubular elbow frame component, of the series of tubular elbow frame components, one after the other, to form a single continuous loop;

wherein the single continuous loop forms an overall frame shape of the playground structure frame; and wherein the overall frame shape of the playground structure frame has ais in the shape of an Archimedean polyhedron.

7. The playground structure frame of claim 6, wherein the series of tubular elbow frame components are a series of tubular curved elbow frame components.

8. The playground structure frame of claim 7, wherein each individual tubular straight frame component, of the series of tubular straight frame components, is interconnected end-to-end with each individual tubular curved elbow frame component, of the series of tubular elbow frame components, to form the single continuous loop.

9. The playground structure frame of claim 6, wherein the Archimedean polyhedron is a truncated octahedron.

10. The playground structure frame of claim 6, wherein a support structure is connected to the single continuous loop such that the single continuous loop is vertically offset from ground level.

11. A playground structure that includes a frame, wherein the frame comprises:

a series of individual tubular straight frame components and a series of individual tubular curved frame components;

wherein each individual straight frame component, of the series of individual tubular straight frame components, is connected end-to-end to each individual curved frame component, of the series of individual curved frame components, one after the other in a single line to form a continuous frame loop having a particular desired overall frame shape; and wherein the particular desired overall frame shape is in the shape of an Archimedean polyhedron.

12. The playground structure of claim 11, wherein the series of individual tubular straight frame components and the series of individual tubular curved components are connected end-to-end, consecutively one after the other, in the single line, such that a first individual tubular straight frame component is separated from a second individual tubular straight frame component by an individual tubular curved component.

13. The playground structure of claim 11, wherein the series of individual tubular straight frame components and the series of individual tubular curved frame components form an endless frame having partially or completely concealed joints.

14. The playground structure of claim 11, wherein a support structure is connected to the frame and causes the frame to be vertically offset from the ground.

15. The playground structure of claim 11, wherein the shape of the Archimedean polyhedron is a shape of a truncated octahedron.

* * * * *